US010632780B2

(12) United States Patent
Baker et al.

(10) Patent No.: US 10,632,780 B2
(45) Date of Patent: Apr. 28, 2020

(54) WATERMARKING

(71) Applicant: DE LA RUE INTERNATIONAL LIMITED, Basingstoke, Hampshire (GB)

(72) Inventors: Malcolm Paul Baker, Hampshire (GB); Christian David Paul Clark, Gloucestershire (GB)

(73) Assignee: PORTALS DE LA RUE LIMITED, Basingstoke (GB)

( * ) Notice: Subject to any disclaimer, the term of this patent is extended or adjusted under 35 U.S.C. 154(b) by 0 days.

(21) Appl. No.: 15/591,940

(22) Filed: May 10, 2017

(65) Prior Publication Data

US 2017/0239973 A1 Aug. 24, 2017

Related U.S. Application Data

(63) Continuation of application No. PCT/GB2015/053391, filed on Nov. 9, 2015.

(30) Foreign Application Priority Data

Nov. 10, 2014 (GB) ..... 1419983.0

(51) Int. Cl.
*D21F 1/44* (2006.01)
*D21H 21/40* (2006.01)
(Continued)

(52) U.S. Cl.
CPC ..... *B42D 25/333* (2014.10); *B42D 25/24* (2014.10); *B42D 25/29* (2014.10); *B42D 25/425* (2014.10); *D21F 1/44* (2013.01); *D21H 21/40* (2013.01)

(58) Field of Classification Search
CPC ..... D21F 1/44; D21F 11/006; D21F 1/105; D21F 3/105; B42D 25/333; B42D 25/425;
(Continued)

(56) References Cited

U.S. PATENT DOCUMENTS 1,901,049 A 3/1933 Von Heinrich
2,009,185 A 7/1935 McCorkindale
(Continued)

FOREIGN PATENT DOCUMENTS

DE 10327248 A1 1/2005
DE 102006058513 A1 * 6/2008 ..... D21F 1/0036
(Continued)

OTHER PUBLICATIONS

Machine Translation of EP 2899312 A1 (Year: 2015).*
(Continued)

*Primary Examiner* — Jose A Fortuna
(74) *Attorney, Agent, or Firm* — Ohlandt, Greeley, Ruggiero & Perle, L.L.P.

(57) ABSTRACT

The present invention relates to a watermark formation element for forming watermarks in paper, a cylinder mould cover comprising such a watermark formation element, a method of making such a cylinder mould cover, a method of making paper using such a cylinder mould cover and paper made thereby. The watermark formation element has an integrated body comprising a watermark forming surface, which has one or more watermark forming regions, and a drainage surface. A plurality of drainage channels extend from front surface apertures in the watermark forming surface to the drainage surface. At least some of the front surface apertures are shaped to define at least one of an alphanumeric, a symbol or a pictorial image. A filter layer located between the watermark forming surface and the
(Continued)

drainage surface having filter layer apertures which have a maximum width which is less than a smallest width of the front surface apertures.

23 Claims, 22 Drawing Sheets

(51) Int. Cl.
*B42D 25/333* (2014.01)
*B42D 25/24* (2014.01)
*B42D 25/29* (2014.01)
*B42D 25/425* (2014.01)

(58) Field of Classification Search
CPC ..... B42D 25/24; B42D 25/29; D21H 21/40; D21H 21/48
See application file for complete search history.

(56) References Cited

U.S. PATENT DOCUMENTS

| | | | | |
|---|---|---|---|---|
| 2003/0102098 | A1* | 6/2003 | Allen | D21F 3/105 162/203 |
| 2005/0163970 | A1 | 7/2005 | Pearson | |
| 2010/0175843 | A1 | 7/2010 | Andre et al. | |
| 2011/0290435 | A1* | 12/2011 | Krul | D21F 1/0063 162/110 |
| 2013/0092337 | A1 | 4/2013 | Andre et al. | |
| 2013/0255896 | A1* | 10/2013 | Doublet | D21F 11/006 162/110 |
| 2016/0108581 | A1* | 4/2016 | Olmos | B41M 3/14 283/85 |
| 2017/0225503 | A1* | 8/2017 | McLean Henderson | B42D 25/23 |
| 2017/0239973 | A1* | 8/2017 | Baker | D21F 1/44 |
| 2018/0258588 | A1* | 9/2018 | Pearson | B42D 25/333 |

FOREIGN PATENT DOCUMENTS

| | | | | | |
|---|---|---|---|---|---|
| DE | 102006058513 | A1 | | 6/2008 | |
| EP | 0367520 | A2 | | 5/1990 | |
| EP | 1468142 | | | 10/2004 | |
| EP | 1937893 | A2 | | 7/2008 | |
| EP | 2826915 | A1 | * | 1/2015 | |
| EP | 2899312 | A1 | | 7/2015 | |
| GB | 192950 | A | * | 2/1923 | D21F 1/46 |
| GB | 192950 | A | | 2/1923 | |
| GB | 2532079 | A | * | 5/2016 | D21F 1/44 |
| GB | 2532081 | A | * | 5/2016 | D21F 1/44 |
| GB | 2532082 | A | * | 5/2016 | D21F 1/44 |
| GB | 2532083 | A | * | 5/2016 | D21F 1/44 |
| GB | 2532084 | A | * | 5/2016 | D21F 1/44 |
| GB | 2556964 | A | * | 6/2018 | D21F 1/44 |
| WO | 2007028485 | A2 | | 3/2007 | |
| WO | 2011/117828 | A1 | | 9/2011 | |
| WO | 2011/137941 | A1 | | 11/2011 | |
| WO | WO-2014015978 | A1 | * | 1/2014 | |
| WO | WO-2016075442 | A1 | * | 5/2016 | D21F 1/44 |
| WO | WO-2016075443 | A1 | * | 5/2016 | D21F 1/44 |
| WO | WO-2016075450 | A1 | * | 5/2016 | D21F 1/44 |

OTHER PUBLICATIONS

Machine translation of DE 103 27 248 A1 (Year: 2005).*
International Search Report dated Apr. 28, 2016 from corresponding PCT International Application No. PCT/GB2015/053391, 5 pages.
Written Opinion dated Apr. 28, 2016 from corresponding PCT International Application No. PCT/GB2015/053391, 10 pages.
Great Britain Examination Report dated Nov. 19, 2015 in corresponding Great Britain Application No. GB1419983.0, 4 pages.

* cited by examiner

WATERMARKING

CROSS REFERENCE TO RELATED APPLICATIONS

This application is a continuation of International Application No. PCT/GB2015/053391 filed on Nov. 9, 2015, which claims the benefit of British Application No. GB 1419983.0 filed Nov. 10, 2014, the entire contents of both of which are incorporated by reference herein.

BACKGROUND

1. Field of the Disclosure

The present disclosure relates to a watermark formation element for forming watermarks in paper, a cylinder mould cover comprising such a watermark formation element, a method of making such a cylinder mould cover, a method of making paper using such a cylinder mould cover and paper made thereby.

2. Description of the Related Art

The use of watermarks is fairly common in many security documents. High security multi-tonal watermarks are typically created using a cylinder mould process and these are commonly known as cylinder mould watermarks. Cylinder mould watermarks are formed by varying the density of paper fibres so that in some regions the fibres are denser, and in others less dense, than that of the base paper layer which surrounds and separates the denser and less dense regions. When viewed in transmitted light the less dense regions are lighter and the denser regions darker than the base paper and the contrasts can be seen very clearly. Different types of watermarks have different advantages. A cylinder mould watermark, usually formed on an embossed cylinder mould cover, is often a pictorial image, such as a portrait, and can be very detailed and complex which significantly reduces the risk of counterfeiting.

SUMMARY

In cylinder mould papermaking, paper is formed on a partially submerged wire cloth covered mould cylinder, which rotates in a vat containing slurry comprising a dilute suspension of paper fibres. As the mould cylinder rotates, water is drawn through the wire cloth depositing fibres onto the cylinder surface. When the wire cloth of the cylinder mould cover is embossed, the fibres deposit with a lesser or greater thickness on the raised and sunken elements respectively of the embossing to form a three-dimensional watermark in the finished paper.

The variation in paper thickness in the final watermark is a result of fibre movement from the raised regions of the embossed mesh to the sunken regions of the embossed mesh as the water is drawn through the wire cloth. The fibre movement, and therefore the tonal variation in the watermark, is governed by the drainage rate and that is dependent on the profile of the embossing. This enables excellent control in the gradation of the watermark pattern, producing a subtle tonal range that is unique to the embossed cylinder mould watermark process.

Traditional embossed cylinder mould watermarks have to be made within the constraints imposed by the physical properties of the wire cloth. Embossing the wire cloth of the cylinder mould cover reduces its strength and increases the risk of damage to the mould cover and the paper during the papermaking process. This is particularly the case if there is a sharp transition from a deep area of embossing to a significantly raised area. Furthermore, within a complex pictorial watermark it is difficult to juxtapose a very light tone next to a very dark tone due to the stresses that this would place on the mould cover itself during embossing. The limit on the "verticality" of a sidewall within an embossing is approximately 70% to avoid these problems. However, the more vertical the side wall, the sharper the image as there is a greater contrast between a light and dark area. One way around these problems to is use an overcut on the embossing die, which provides the space for the deformation of the wire cloth. However it is often very difficult to adjust the watermark image to provide such overcuts.

The watermark image resolution is also constrained by the coarseness of the mesh of the wire cloth. Furthermore, the wire cloth superimposes a mark on the paper as a consequence of it being a woven structure. This may also detract from the resolution and clarity of the watermark image.

Some of these constraints can be reduced by using a finer wire, but this leads to reduced mould cover durability as finer wires wear out faster.

It is also very difficult to produce light watermark regions exhibiting a significant surface area using the embossed cylinder mould technique.

An alternative process for generating uniform light tonal regions (and providing enhanced watermark security) is the electrotype process. In the electrotype process a thin piece of metal, generally in the form of an image or letter, is applied to the wire cloth of the cylinder mould cover, usually by sewing or welding. The electrotype creates a significant decrease in drainage and fibre deposition and thereby forms a light watermark in the paper. An electrotype watermark produced in this manner may be lighter than the lightest areas of an embossed cylinder mould watermark. The electrotyping process is well known in papermaking and has been described, for example, in U.S. Pat. Nos. 1,901,049 and 2,009,185.

An electrotype watermark is therefore an area of paper having just a uniform decrease in paper thickness. The area is typically quite small and the change in paper thickness (fibre density) is quite distinct so as to create very light areas. The electrotype process is limited in that, if the electrotype is too large, this can produce a hole in the paper. The typical width of the electrotype is between 0.2 to 1.2 mm and the thickness is between 500 and 700 μm, to avoid such problems.

Both of the aforementioned types of watermark have security (anti-counterfeiting) benefits and have provided the backbone of paper security for hundreds of years. However, both can be compromised and, as with all security devices, there is a need to improve them. One approach is to provide ever more complex and technically demanding designs.

Such complex designs may require the combination of both embossed cylinder mould and electrotype watermarks, or watermark areas, in the same design. For example electrotypes have been used to produce very light highlights within an embossed cylinder mould watermark. One such example is a watermark in the form of the head of an animal, in which the bright eyes of the lion are electrotype watermarks. In transmission the eyes will appear significantly brighter than the parts of the watermark produced by the embossing and will therefore provide a level of contrast not usually achievable by an embossed watermark alone.

One problem with integrating an electrotype watermark into an embossed cylinder mould watermark lies in the difficulty in attaching the electrotype to the undulating embossed region of the wire cloth of the cylinder mould. The specific area to which the electrotype is attached must be flat, which of course is problematic within an undulating structure. However, the process for placing an electrotype within the embossed region of the wire cloth is very difficult. A reinforced platform, or other form of support, is usually required whilst the electrotype is being welded to the wire cloth, to prevent deformation of the wire cloth, and therefore the embossing. Any deformation can lead to the watermark design being compromised. However, it is often the case that it is difficult to provide the appropriate support due to the nature of the embossing.

The addition of an electrotype to an embossed cylinder mould cover is also a time consuming process. This increases the time to produce the cylinder mould cover for production, and the cost thereof. The process for producing cylinder mould covers for embossed cylinder mould watermarks is already lengthy. Once the art work is created, this has to be converted into a program which operates a milling machine to produce the embossing dies. The embossing dies are then used to emboss the wire mesh.

As an alternative to using electrotypes for producing highlights in a cylinder mould watermark, it is possible to close the mesh openings in certain areas to prevent drainage. However, this does not create the sharpness of contrast which is possible with electrotypes.

A cylinder mould machine is generally used to manufacture one or more webs of paper. The web is subsequently slit into interim sheets of paper and then usually further slit into smaller sheets for making documents. The length of the cylinder mould cover, on which the paper is formed, is determined by the number of webs to be produced, where the width of each web corresponds to the width of one interim sheet. Typically, the length will be such as to produce three webs. The circumference of the cylinder mould cover is equivalent to the length of a number of interim sheets. As a non-limiting example, there may be three webs and six interim sheets, so the surface area of the cylinder mould cover would corresponding to the surface area of 18 (3×6) interim sheets. As each interim sheet is subsequently slit into a plurality of smaller security documents, the number of watermarks produced in each interim sheet must be such as to produce the requisite watermarks in each of the finished documents. A typical mould cover may therefore have embossings/electrotypes for around 700 documents.

However, it may be convenient for each of the webs to have different watermarks. This enables the production in a single manufacturing run of, for example, all the pages for a passport which have different watermarks on each page. The requirement for different watermarks on different webs adds complications to the manufacture of the cylinder mould cover, because of the difficulty of placing them robotically. This also significantly adds to the cost, because of the cost of making individual dies or electrotypes for each variant.

In order to maximise the difference between the light and dark areas of a watermark formed by the profiled surface of the embossings, it is desirable to control the drainage in both the raised and sunken areas of the embossing. This is currently achieved in the raised areas by reducing the drainage rate (i.e. the rate at which water passes through the wire cloth during the forming process), typically by placing an impermeable element, such as a metal plate or plastic element, beneath the innermost layer of the wire cloth. The weave structure of the wire cloth still allows water to drain laterally there through, albeit at a reduced rate. However radial drainage is blocked by the impermeable element.

In the sunken areas, control is achieved by increasing the overall drainage rate, for example by applying a vacuum to the cylinder mould, or by starting the draining process below the stock level, for example by using a mould curtain. Another method is to increase the embossing depth of the forming surface. This, however, makes the mould cover more vulnerable to damage and can result in difficulties releasing the partially formed paper onto the felt (formex) which transports the paper from the wet end of the paper-making machine to the press section.

Neither of these solutions is very effective. Underwire drainage restriction is limited by the lateral drainage resulting from the 3-dimensional structure of the wire cloth. The application of vacuum and the mould curtain both affect the raised and sunken areas simultaneously, making them coarse tools for selective drainage control.

US-A-2010/0175843 and US-A-2013/0092337 propose an alternative method of producing multi-tonal watermarks. In this method, instead of embossing the cylinder mould cover, a perforated watermark "insert" is attached to the cylinder mould cover which provides a multi-level relief. The insert may be injection moulded to provide the profiled surface perforations. Alternatively the insert is deep drawn or hot stamped.

US-A-2013/0255896 also proposes an alternative method of producing multi-tonal watermarks. In this method, a "part" is attached to the cylinder mould cover, which part has a profiled surface and conical perforations extending from the profiled surface to an opposing drainage surface. The part is made by a laser sintering method, such as SLM or SLS.

There is, however, always a need to improve the watermarking process. One object is to improve the quality of watermarks and in particular to improve the ability to create the effects produced currently by embossed cylinder mould and electrotype watermarks, so that complex multitonal designs or images can be created with sharply contrasting dark and very light areas adjacent each other.

Another object is to provide a process for the production of cylinder mould covers which enables each watermark, or some watermarks, to be individually modified.

Yet another object is to improve the process for the production of cylinder mould covers by decreasing the time taken from the production of the art work to the completion of the mould cover.

A further object is to reduce the cost of production of cylinder mould covers by simplifying the manufacturing process, whilst retaining the ability to produce complex multi-tonal designs or images with sharply contrasting dark and very light areas adjacent each other from the resulting cylinder mould cover.

A further object still is to reduce the cost of production of cylinder mould covers by utilising a process which enables cheaper materials to be used and to reduce material wastage.

The disclosure therefore provides a watermark formation element for forming at least one watermark in a paper, said watermark formation element having an integrated body comprising a watermark forming surface, which has one or more watermark forming regions, and a drainage surface, said watermark formation element having a plurality of drainage channels extending from front surface apertures in the watermark forming surface to the drainage surface, wherein at least some of the front surface apertures are shaped to define at least one of an alphanumeric, a symbol or a pictorial image, and further comprising a filter layer located between the watermark forming surface and the drainage surface having filter layer apertures which have a maximum width which is less than a smallest width of the front surface apertures which define the at least one of an alphanumeric, a symbol or a pictorial image.

Preferably the shape of the watermark formation element is an alphanumeric, symbol or pictorial image.

The disclosure also provides a watermark formation element for forming at least one watermark in a paper, said watermark formation element having an integrated body comprising a watermark forming surface, which has one or more watermark forming regions, and a drainage surface, said watermark formation element having a plurality of drainage channels extending from front surface apertures in the watermark forming surface to the drainage surface, wherein the front surface apertures are shaped to define at least two different shapes.

The disclosure also provides a watermark formation element for forming at least one watermark in a paper, said watermark formation element having an integrated body comprising a watermark forming surface, which has one or more watermark forming regions, and a drainage surface, said watermark formation element having a plurality of drainage channels extending from front surface apertures in the watermark forming surface to the drainage surface, wherein the shape of the watermark formation element is an alphanumeric, symbol or pictorial image.

Preferably at least some of the front surface apertures are shaped to define at least one of an alphanumeric, a symbol or a pictorial image.

The shape defined by the at least some of the front surface apertures is preferably the same as, or related in context to, the shape of the watermark formation element.

Preferably the at least one alphanumeric, symbol or pictorial image defined by the at least some of the front surface apertures is negative or is positive.

In a preferred embodiment at least one alphanumeric, symbol or pictorial image defined by the at least some of the front surface apertures is positive and at least one alphanumeric, symbol or pictorial image defined by the at least some of the front surface apertures is negative.

Preferably said watermark formation element is formed from a plurality of layers, each layer being provided with drainage apertures, the drainage apertures in each layer at least partially overlap the drainage apertures in any adjacent layers to form said drainage channels.

Preferably each layer is formed from a plurality of sub layers.

The layers and/or sub layers are preferably fused together to form the integrated body.

Preferably the watermark formation element is formed by 3D printing.

The watermark formation element may be formed from a polymeric material or a plurality of different polymer materials or from a metallic material or a plurality of different metallic materials.

Preferably the minimum cross-sectional area of the front surface aperture and of any section of the drainage channels is 0.01 $mm^2$.

The shape of the drainage apertures in different layers may be different.

Preferably any one layer may have drainage apertures, the cross sectional area and/or shape of are not all the same.

The total cross sectional area of the front surface apertures preferably lies in the range of 1% to 40% of the total surface area of the watermark formation element, preferably 15% to 30% and more preferably 15% to 25%.

The layers may be planar or non-planar.

Preferably the watermark formation surface is contoured in the one or more watermark forming regions to provide tonal variation in the paper formed thereon.

In a preferred embodiment the shape, size, spacing and or distribution of the drainage surface apertures is varied within the one or more watermark forming regions to provide tonal variation in the paper formed thereon.

Preferably the minimum width of the front surface apertures which are used to form the at least one alphanumeric, pictorial image or symbol lie in the range 0.1 to 5.0 mm, more preferably in the range of 0.3 to 3.0 mm, and most preferably in the range of 0.3 to 1.0 mm.

The width of the filter layer apertures 37 is preferably in the range of 0.1 to 1 mm and more preferably in the range of 0.4 to 1.0 mm.

The maximum distance from the watermark formation surface to the filter layer may be in the range of 0.1 to 3.0 mm, and preferably in the range of 0.3 to 2.00 mm.

The thickness of the filter layer may be in the range of 0.1 to 1.0 mm and preferably in the range of 0.3 to 0.6 mm.

The thickness of a layer which provides the drainage surface is preferably in the range of 0.6 to 6.0 mm and preferably in the range of 1 to 3.0 mm.

The invention further provides a cylinder mould cover for manufacturing a paper having at least one watermark, comprising a at least one foraminous layer and at least one watermark formation element attached thereto.

Preferably, the watermark formation element is located in a recess formed in the at least one foraminous layer or in a cut out portion formed in the least one foraminous layer.

Alternatively, the watermark formation element is located in a recess formed in the at least one foraminous layers and a cut out portion formed in another foraminous layer.

The disclosure further provides a method of making the cylinder mould cover wherein the one or more watermark formation elements are formed by a 3D printing process.

The one or more watermark formation elements may be formed and subsequently attached to the least one foraminous layer.

Alternatively, the one or more watermark formation elements may be formed directly on the least one foraminous layer.

The disclosure further provides a method of making watermarked paper comprising the step of depositing fibres on the cylinder mould cover.

The disclosure further provides paper formed by this method.

The disclosure further provides a secure document made from this paper comprising a banknote, a passport, a certificate, a ticket or the like.

BRIEF DESCRIPTION OF THE DRAWINGS

Watermark formation elements and elements thereof, cylinder mould covers and methods of making cylinder mould covers, watermark formation elements and paper will now be described, by way of example only, with reference to the accompanying drawings, in which:—

DETAILED DESCRIPTION

It should be noted that, whilst the following description specifically refers to making paper, this should be interpreted as referring to paper made from any fibrous substrate, whether made from natural and/or synthetic fibres.

Watermarked paper is usually formed on a partially submerged cylinder mould cover, at the wet end of a papermaking machine, as it rotates in a vat containing paper slurry. The paper slurry generally comprises an aqueous suspension of paper fibres, which maybe natural fibres, synthetic fibres or a combination of both. As the cylinder mould rotates, liquid is drawn through the wire cloth 10 depositing fibres onto the face cloth 11.

Figure 1:
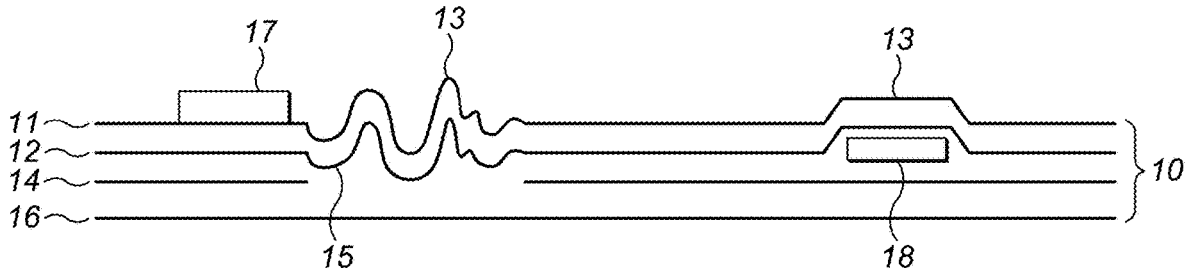
FIG. 1 PRIOR ART
FIG. 1 is cross section of a section of a prior art wire cloth used to form a cylinder mould cover.

A typical prior art cylinder mould cover is formed from a multi-layered wire cloth 10, as shown in FIG. 1. The layers are usually made from wire mesh or another foraminous surface. The outermost layer (when the wire cloth 10 is wrapped around the cylinder mould) is known as the face cloth 11 and the next layer is a backing layer, referred to herein as the first backing layer 12. The face cloth 11 and first backing layer 12 are the layers which are usually provided with embossings 13 which form the watermarks. Behind these layers 11,12 is usually a second backing layer 14, which typically has cut-out areas 15 which accommodate the inwardly projecting areas of the embossings 13. The innermost layer (when the wire cloth 10 is wrapped around the cylinder mould) is usually a third backing layer 16 which is not embossed or cut out, which provides overall support and strength to the overlying layers 11,12,14. Typically the face cloth 11 has the smallest mesh openings, with the third backing (innermost) layer 16 having the largest mesh openings.

To form electrotype watermarks, electrotypes 17 may be attached to the face cloth 11 by a suitable method, such as welding or soldering.

For some types of embossings 13, supporting elements 18 may be inserted between the rearmost embossed layer, in this example first backing layer 12, and the next adjacent layer, in this example the third backing layer 16. The supporting elements 18 are typically made from stainless steel with holes drilled therein to provide drainage. These supporting elements 18 do not provide drainage restriction in the way that electrotypes 17 do, but are provided to help prevent distortion of the embossings 13 when the mould cover is subjected to pressure during the papermaking process.

Figure 2A:
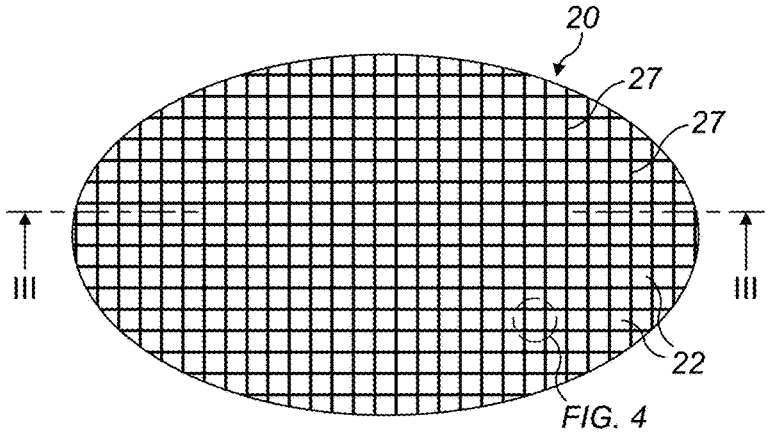
FIGS. 2*a* and 2*b* are plan views of different watermark formation elements.
Figure 3A:
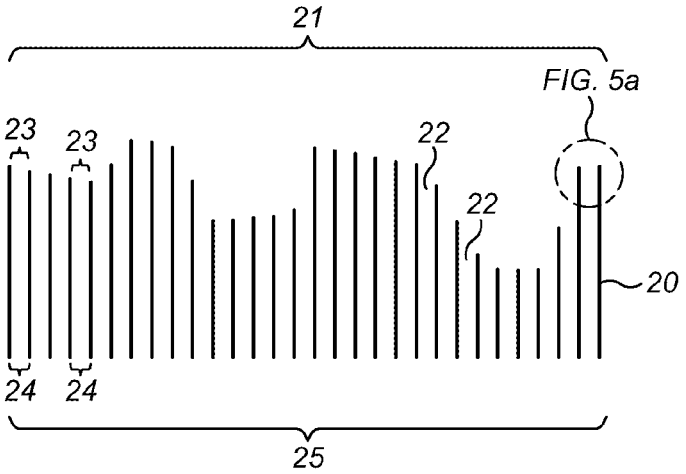
FIG. 3*a* is a cross sectional side elevation of the watermark formation element of FIG. 2*a* on the line III-III.
Figure 18:
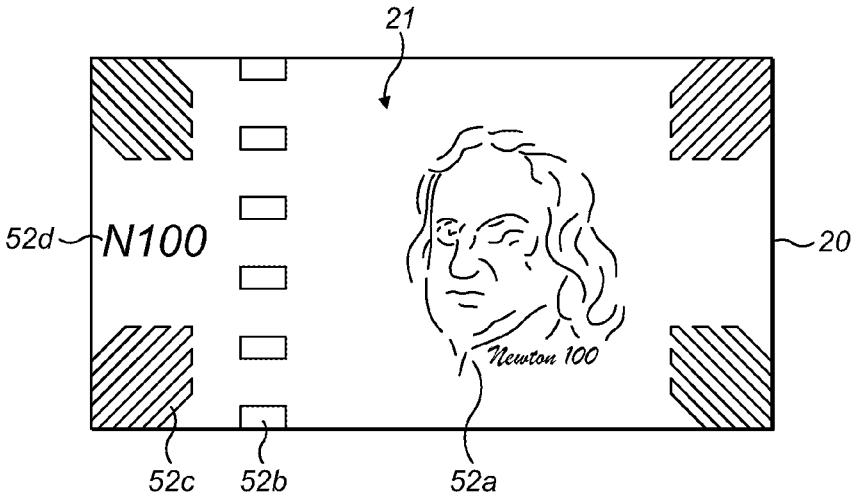
FIG. 18 is a plan view of a single watermark formation element.

As an alternative to using the embossings 13 and/or electrotypes 17 of the prior art, watermarks may be formed using watermark formation elements 20 (see FIGS. 2*a* and 3*a*). At least one watermark formation element 20 is preferably attached to the wire cloth 10 of the cylinder mould cover. It should be noted that the wire cloth 10 may have a similar construction to that of FIG. 1, in terms of the number of layers 11,12,14,16, or it may have a different number of layers. The watermark formation element 20 has a watermark forming surface 21 (see FIG. 3*a*). At least a part of the watermark forming surface 21 may have a contoured profile, like the surface of a watermark embossing 13, which provide one or more watermark forming sections 52*a-d* shown in FIG. 18. The fibres deposit with a lesser or greater thickness on the raised and sunken elements of the watermark forming section(s) 52 to form a 3-dimensional watermark in the finished paper. The watermark forming surface 21 may also have non-contoured sections (non-watermark forming sections) on which paper is produced which has no watermarks. However, the deposition of fibres to form watermarks may be controlled by additional and/or alternative means, for example by varying the drainage rate of the liquid from the paper slurry through the watermark formation element. These means are described below.

The watermark formation element 20 has an integrated body (i.e. one not comprising discernible separate layers) a plurality of drainage channels 22 extending from front surface apertures 23 in the watermark forming surface 21 to drainage surface apertures 24 in an opposing drainage surface 25 (see FIGS. 3*a* to 3*d*). The drainage channels 22 are not just located in the watermark forming sections 52, but also in the non-watermark forming sections. The drainage channels 22 allow liquid from the paper slurry to drain through the watermark formation element 20 to enable the fibres to deposit on the watermark forming surface 21. The cross sectional area of each drainage channel 22 preferably increases as it extends from the watermark forming surface 21 to the drainage surface 25 to encourage the flow of liquid (as shown in FIGS. 6*a* to 6*e*). Preferably the minimum cross sectional area of the front surface apertures 23 and of any section of the drainage channels 22 is 0.01 $mm^2$. However, the cross sectional area of one or more drainage channels 22 may remain constant as it extends from the watermark forming surface 21 to the drainage surface 25, or it may decrease.

Each of the front surface apertures 23 preferably has a curved rim 26 which extends from the watermark formation surface 21 to an inner wall 29 of the drainage channel 22. The radius of curvature (r) of the rim 26 is selected to reduce fibre retention as the liquid drains through the watermark formation element 20 and to help in the cleaning of the watermark formation element 20. The rim 26 preferably has a radius of curvature (r) (see FIGS. 5*a* and 5*b*) in the range of 0.05 to 0.25 mm, and more preferably in the range of 0.1 to 0.15 mm.

The continuous flow of liquid through the drainage channels 22 is important, as blockages can lead to imperfections in the watermark. The size, number, cross-sectional shape and/or profile of the drainage channels 22 are preferably selected to provide controlled drainage rates in different areas to form the desired watermark(s). Thus, the watermark formation element(s) 20 and cylinder mould cover provide a forming surface with variable porosity, such that areas with lower porosity produce reduced grammage (i.e. lighter areas with a lower density of fibres) areas in the paper, and areas with higher porosity enable higher grammage areas (i.e. darker areas with a higher density of fibres) to be produced.

From FIGS. 3*a* to 3*d* it can be seen that some of the drainage channels 22 may be longer than others as a result in a varying profile of the watermark forming surface 21. The longer drainage channels 20 provide more resistance to the flow of liquid flow than the shorter drainage channels 20 and therefore produce lighter areas in the paper than those produced by the shorter drainage channels 20. Variations in paper density may thus be controlled not only by the variations in the profile of the watermark forming surface 21, but also (alternatively or in addition) by the rate of liquid flow through the drainage channels 22.

Between the front surface apertures 23, the watermark formation surface 21 comprises solid areas 27. These solid areas 27 further enable the control of deposition of fibres on the watermark formation surface 21. These solid areas 27 may be regular and small or may be used, by varying their size and position, to create the equivalent of electrotype watermarks, i.e. significantly brighter/lighter areas. The fibre deposition on each solid area 27 is a function of the width of the solid area 27 (i.e. the distance between adjacent front surface apertures 23) and the height of solid area 27 relative to adjacent portions of the watermark forming surface 21. In order to produce a watermark, the preferred maximum width of a solid area 27 is approximately 2 mm; otherwise the fibres are unable to bridge the solid area 21 which would result in a hole in the paper. However, if it is desirable to create a hole in the paper, the solid areas 27 may be bigger.

Figure 5A:
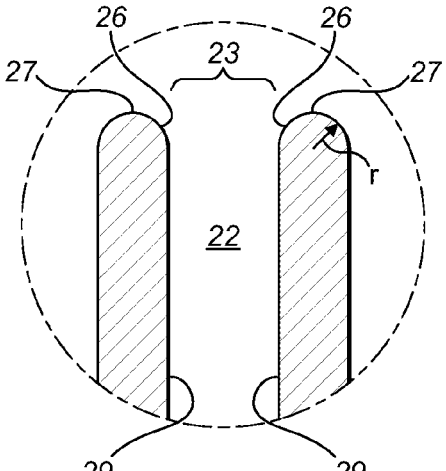
FIGS. 5*a* and 5*b* are cross sectional elevations through an adjacent pair of two different aperture defining members defining the front surface aperture of FIG. 4 on the line V-V.
Figure 5B:
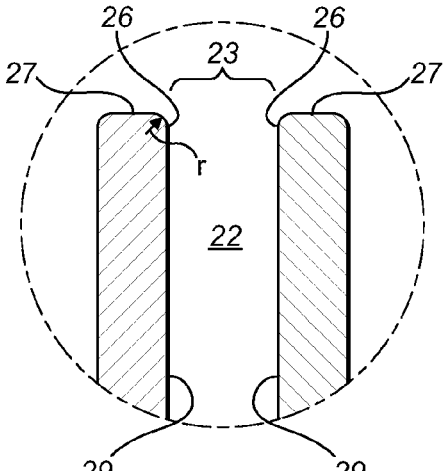
Figure 6A:
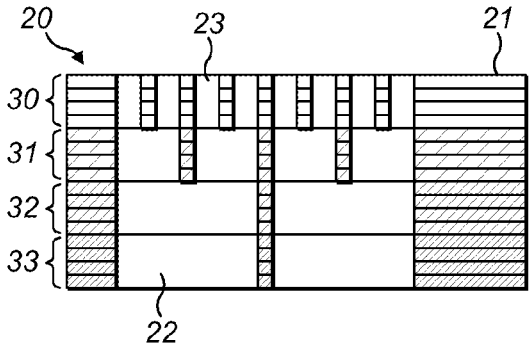
FIGS. 6*a* to 6*e* illustrate the construction of an alternative watermark formation element.
Figure 6B:
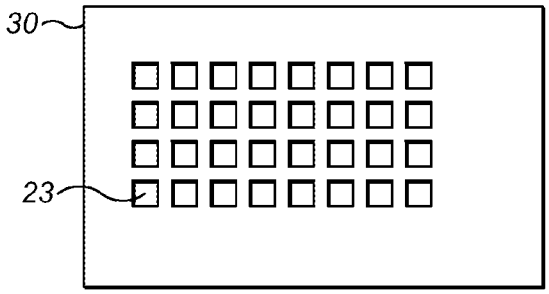
Figure 6C:
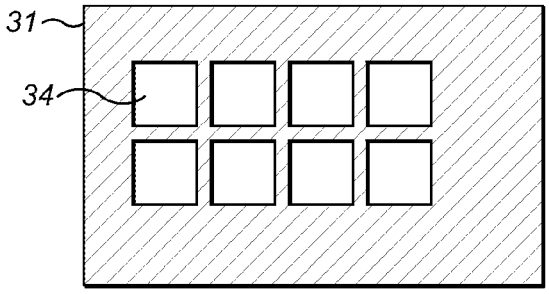
Figure 6D:
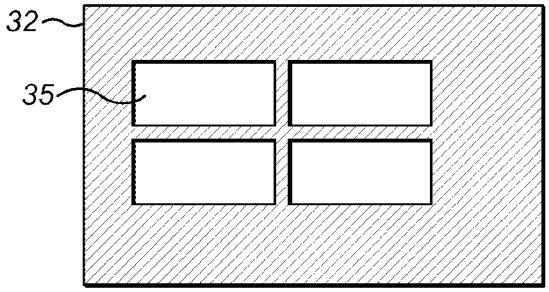
Figure 6E:
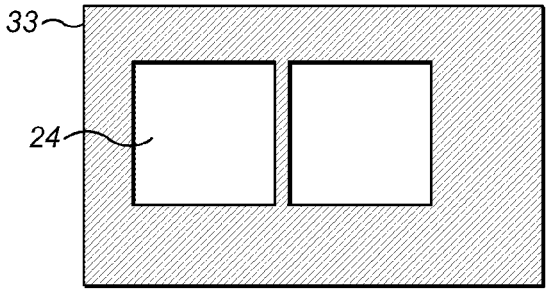

The solid areas 27 may be rounded (as shown in FIG. 5*a*) or flat (as shown in FIG. 5*b*). Where the watermark forming surface 21 has a variable profile, which has peaks (where fibres are less densely deposited) and troughs (where fibres are more densely deposited), the solid areas 27 may be located within the peaks or the troughs, having differing effects. Thus a peak alone would produce a light area, and a high solid area 27 located within the peak would produce an even lighter area. A trough alone would produce a dark area, and a high solid area 27 located within the trough would produce a very bright high light directly adjacent to, or completely surrounded by, a dark area.

Figure 2B:
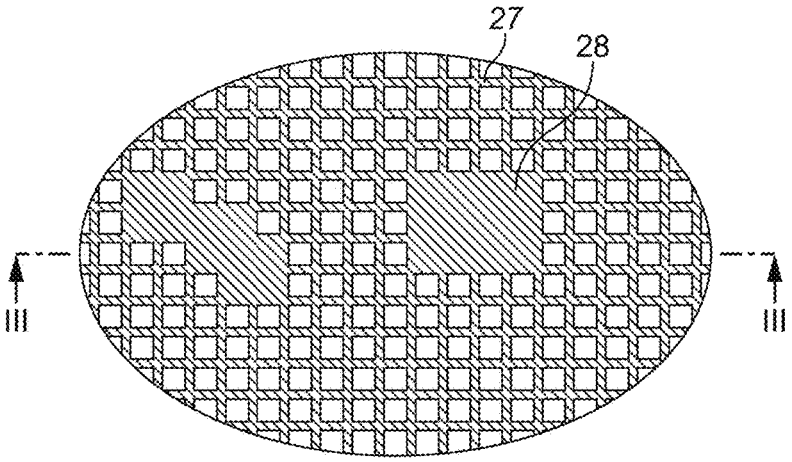
Figure 3B:
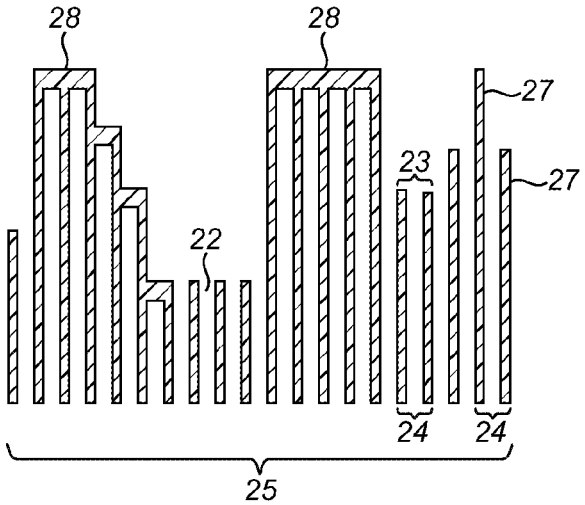
FIGS. 3*b* to 3*d* are cross sectional side elevations of the watermark formation element of FIG. 2*b;*
Figure 3C:
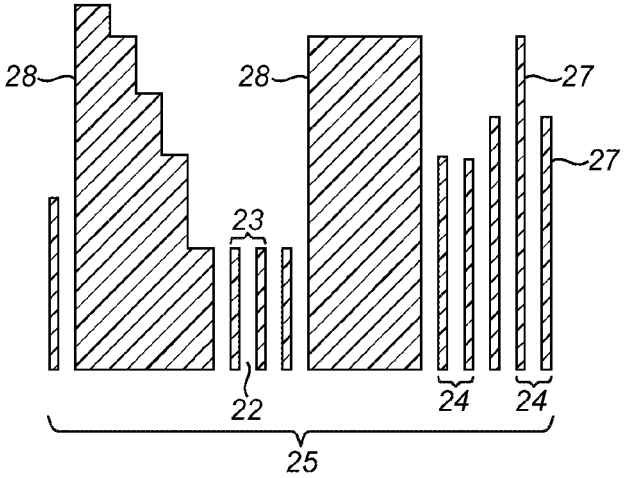
Figure 3D:
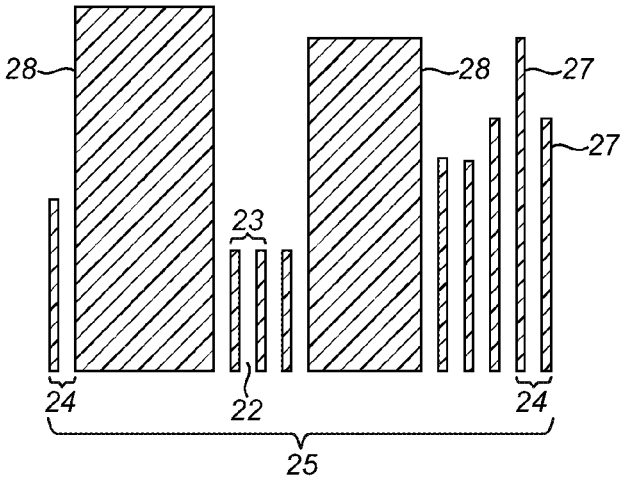
Figure 4:
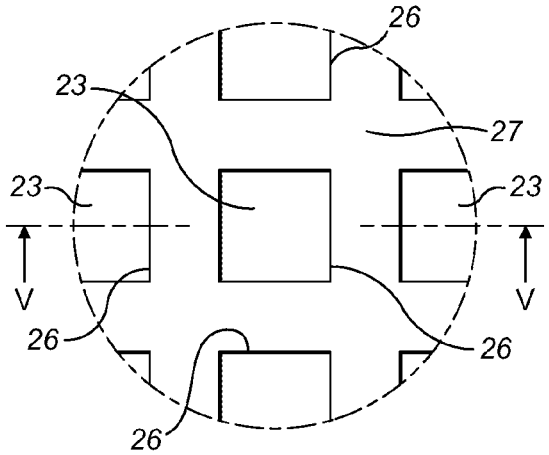
FIG. 4 is a plan view of a front surface aperture in the watermark formation surface of the watermark formation element of FIG. 2.

The solid areas 27 of the watermark formation element 20 may form a regular pattern, for example the mesh like pattern as shown in FIGS. 2*a* and 2*b*. They may also form larger areas, for example the areas marked with reference numeral 28 in FIG. 2*b*. These larger solid areas 28 can be formed in a number of different ways, some examples of which are shown in FIGS. 3*b*-3*d*. In the example illustrated in FIG. 3*b* the larger solid areas 28 extend over, and block off, a number of drainage channels 22. In the examples illustrated in FIGS. 3*c* and 3*d* the larger solid areas 28 extend from the watermark formation surface 21 to the drainage surface 25. In the examples illustrated in FIGS. 3*b* and 3*c* one of the larger solid areas 28 has a variable profile, in this case a stepped profile, whereas the other has a flat surface.

The larger solid areas 28 between the drainage surface apertures 24 preferably have a cross sectional area of at least three times that of the drainage surface apertures 24.

The front surface apertures 24 define a shape, and the shape defined by the front surface apertures 24 may be different from one set of front surface apertures 24 to another. The shape may be a geometric shape, such as a rectangle. Alternatively the shape may be a circle, hexagon or another geometric shape. As a further alternative they may define a non-geometric shape. The shape defined by the front surface apertures 24 may be regular or irregular.

Figure 22:
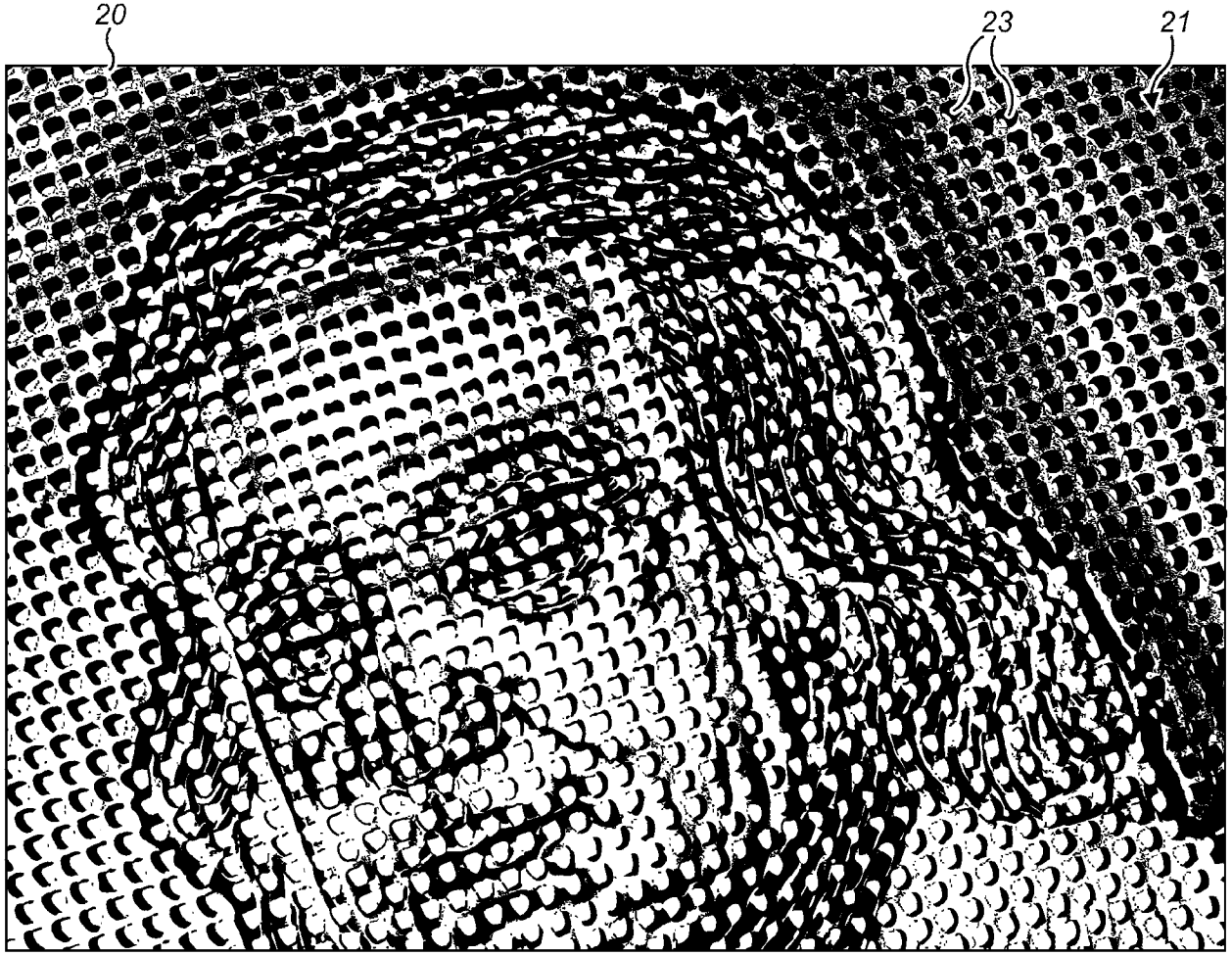
Figure 23:
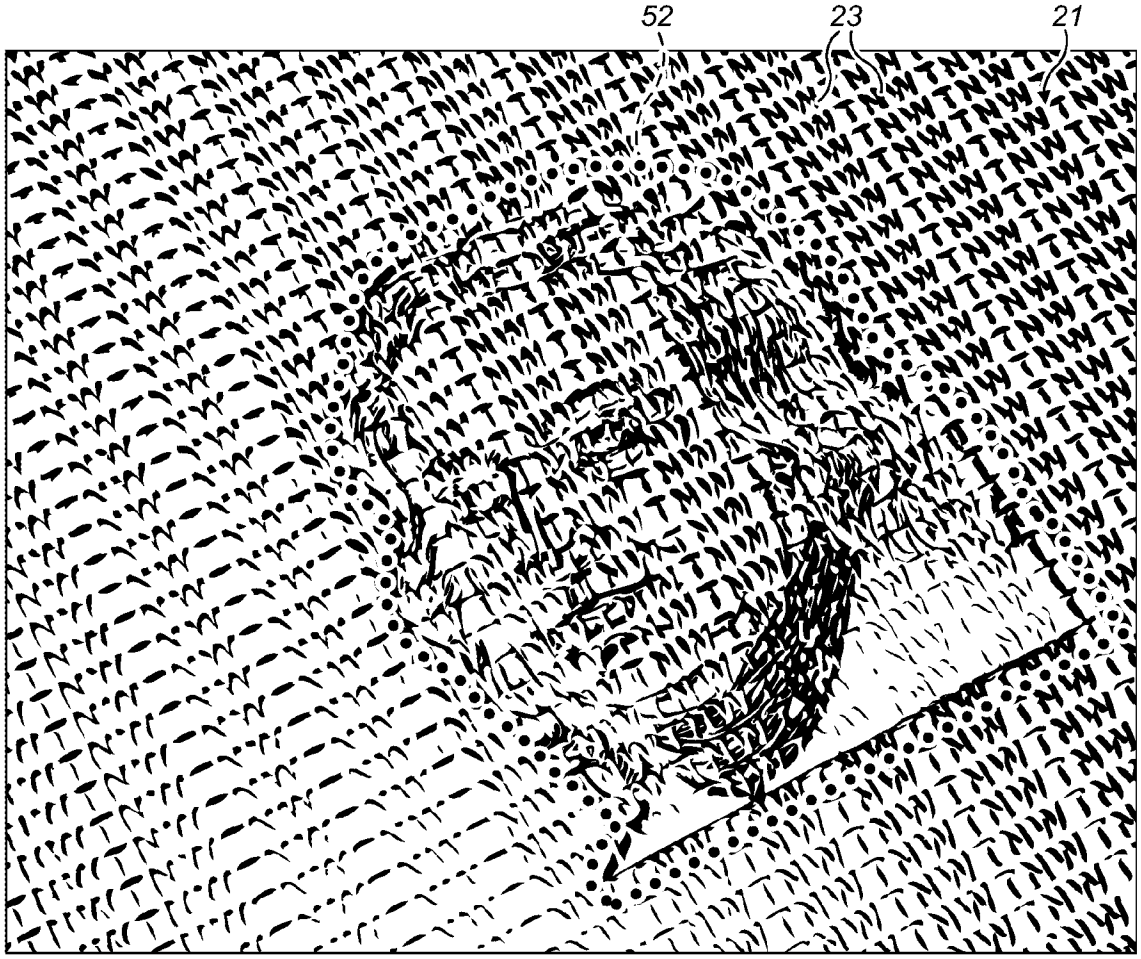
Figure 24:
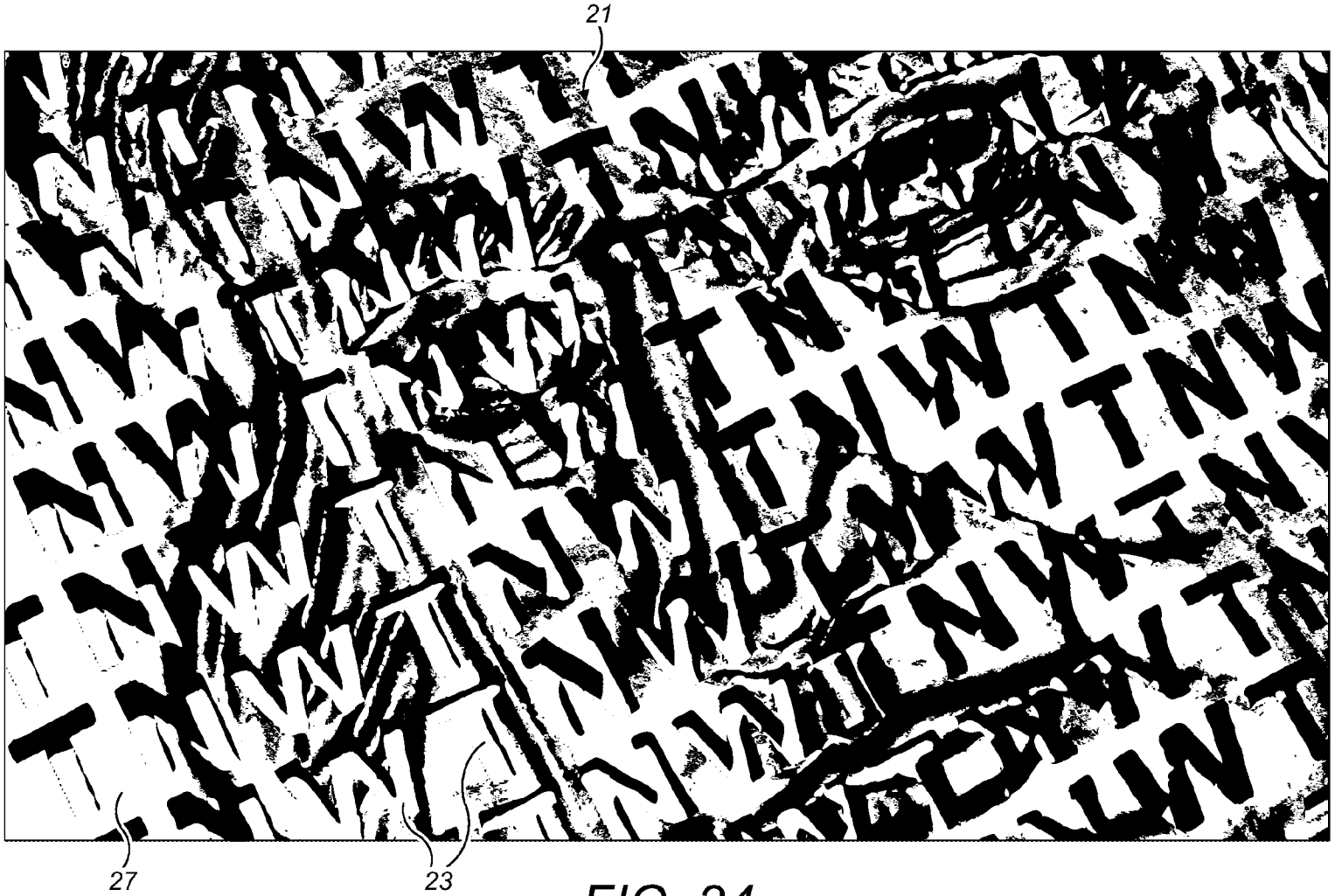
Figure 29:
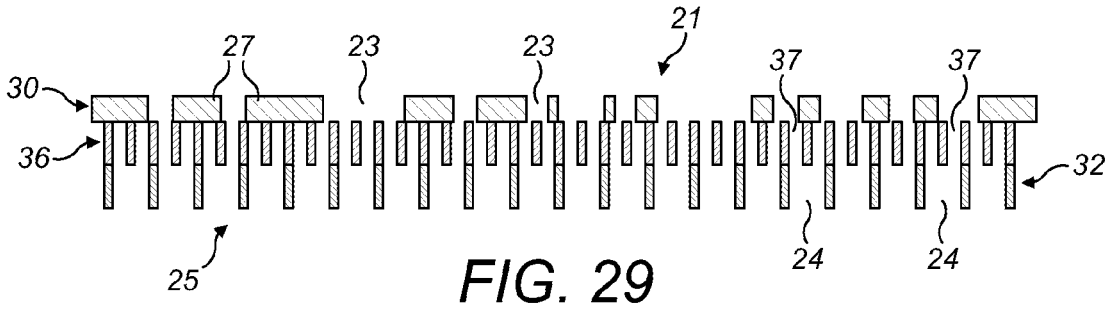
FIGS. 29 and 30 are cross sectional side elevations of a watermark formation element with a filter layer.
Figure 30:
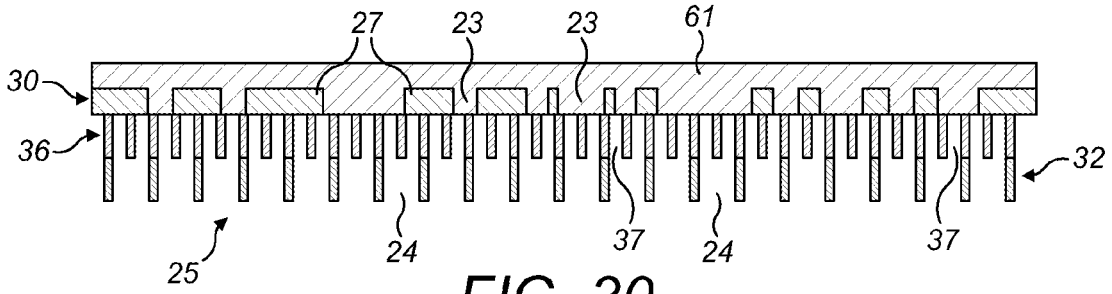
Figure 31:
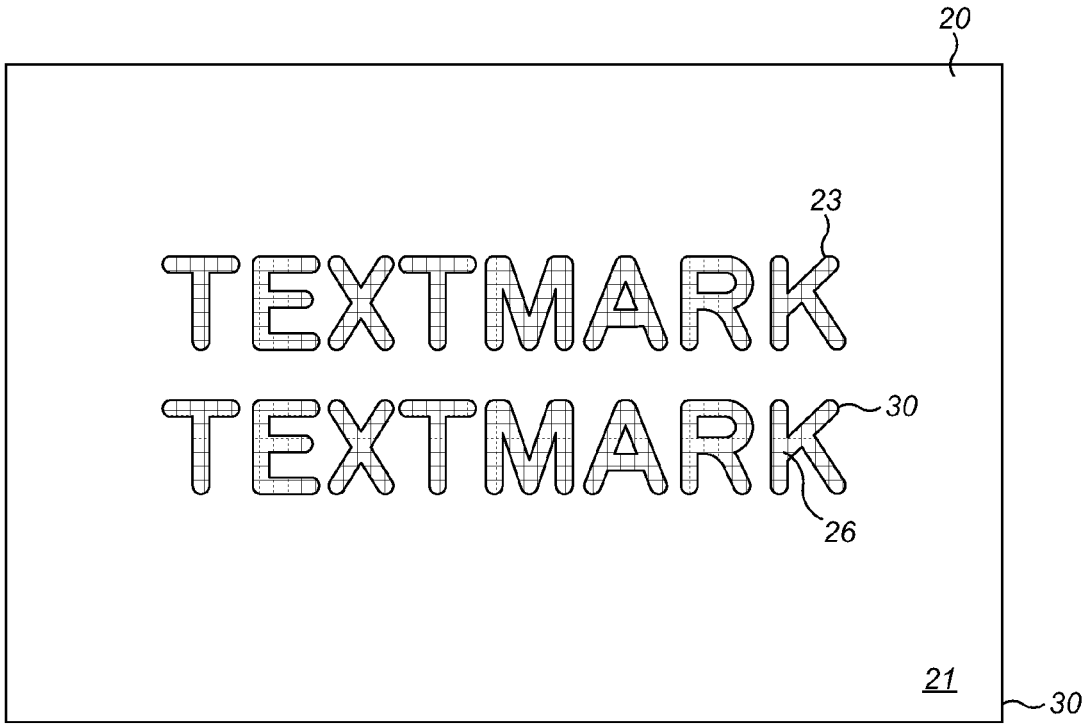
FIG. 31 is a plan view of the watermark formation surface of the watermark formation element of FIGS. 29 and 30, showing the underlying filter later.

The shape defined by the front surface apertures 24 may be in the form of at least one alphanumeric, a pictorial image or a symbol. In the example illustrated in FIG. 22, the front surface apertures 24 themselves are in the shape of an apple. In FIGS. 23 and 24 the front surface apertures 24 are in the form of text, in this example the letters TNW. Preferably the watermark formation element 20 has front surface apertures 24 which define at least two different shapes. In these examples the front surface apertures 24 define the shapes positively. However they may alternatively define the shapes negatively, so that the solid areas 27 between the front surface apertures 24 have the aforementioned shapes. As mentioned above, some of the drainage surface apertures 24 may define the shapes negatively and some may define them positively.

Where the front surface apertures 24 are at least one alphanumeric, a pictorial image or a symbol, the minimum width of the front surface apertures 24 is preferably in the range of 0.1 to 5.0 mm, more preferably in the range of 0.3 to 3.0 mm and most preferably in the range of 0.3 to 1.0 mm. In particular, if the front surface apertures define alphanumerics, the stem width of any character (where it acts a front surface aperture 24) is preferably no thinner than 0.3 mm in width and the space between the characters (the solid areas 27 between the front surface apertures 24) is preferably no smaller than 0.3 mm. The minimum and maximum character size used for the front surface apertures 24 may also be determined by the style of the type face. It should also be noted that, although a minimum front surface aperture 24/stem width size of 0.3 mm may be intended, during the manufacturing process, these dimensions may vary depending on the structure of the model, material and the tolerance of the machine used to manufacture the watermark formation element.

Where the front surface apertures 24 are used to define one or more alphanumerics, a pictorial image or a symbol, in order to make the resulting image(s) clearly defined, the total open cross sectional area of the front surface apertures 24 may be such that paper fibres can penetrate and block the drainage channels 22. This may prevent further drainage and prevent the appropriate amount of fibre build up, leading to poorly formed images. In some instances the paper fibres may pass through the drainage channels 22 altogether, which could lead to holes in the paper. In order to prevent this from occurring, at least one filter layer 36 is located between the watermark forming surface 21 and the drainage surface 25. The filter layer 36 has filter layer apertures 37 which are sized to prevent the paper fibres from passing to far into, or through, the drainage channels 22 to prevent this problem from occurring.

Where the watermark formation element 20 is made up from multiple layers, the filter layer 36 may form one of the middle layers (e.g. replacing the second layer 31 or third layer 32 of FIGS. 6*a*-6*e* described below) of the watermark formation element 20. The filter layer 36 is preferably a grid which has filter layer apertures 37 which have a maximum width which is less than the maximum width of the front surface apertures 23 which form the alphanumerics, a pictorial image or a symbol. Referring to FIGS. 29 and 30, these show a first layer 30 (which in itself may be formed from a number of sub-layers fused together as described below), which has the front surface apertures 23 defining the alphanumerics; a filter layer 36 (which may also be formed from a plurality of sub layers fused together), which has filter layer apertures 37; and a third layer 32 (which may also be formed from a plurality of sub layers fused together), which has the drainage surface apertures 24. A plan view of this construction is shown in FIG. 31, in which the grid of the filter layer 36 can be seen through the front surface apertures 23, which form the text TEXTMARK.

The width of the front surface apertures 23 which are used to form the alphanumeric, pictorial image or symbol preferably lie in the range of 0.1 to 5.0 mm, more preferably in the range of 0.3 to 3.0 mm, and most prefereably in the range of 0.3 to 1.0 mm. The width of the filter layer apertures 37 is preferably in the range of 0.1 to 1 mm and more preferably in the range of 0.4 to 1.0 mm. The size selected, however, will depend on the widths of the front surfaces apertures 23 which are used to form the alphanumeric, pictorial image or symbol. In any area of the watermark formation element 20 in which there are front surface apertures 23 which are not used to form the alphanumeric, pictorial image or symbol, the minimum width of the front surface apertures 23 may be the same or smaller than the minimum width of the filter layer apertures 37.

The effectiveness of the filter layer 36 can be affected by its distance from the watermark formation surface 21. Therefore, the preferred maximum distance, which equates to the maximum thickness of the first layer(s) (30), is in the range of 0.1 to 3.0 mm, and more preferably in the range of 0.3 to 2.00 mm. The thickness of the filter layer 36 is preferably in the range of 0.1 to 1.0 mm and more preferably in the range of 0.3 to 0.6 mm. The preferred thickness of the third layer 32 is preferably in the range of 0.6 to 6.0 mm and more preferably in the range of 1 to 3.0 mm.

Figure 32:
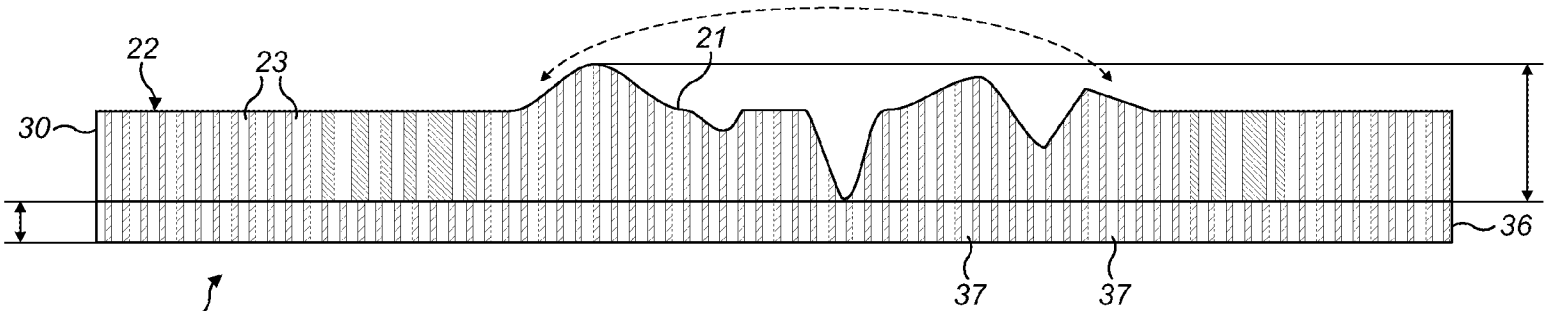
FIG. 32 is a cross sectional side elevations of an alternative watermark formation element with a filter layer.

As shown in FIG. 32, the watermark formation surface 21 may have a varying profile. The regions in which the alphanumeric, pictorial image or symbol is located in this embodiment, are on either side of the regions with the varying profile (although in other embodiments they could be in the same region as the regions of varying profile). The filter layer 36 used in such an arrangement underlies all of these regions. Where there is no variation in the size and spacing of the front surface apertures 23, and therefore the upper sections of the drainage channels 22, the size and spacing of the filter layer apertures 37 may be the same as the size and spacing of the front surface apertures 23 (e.g. in the regions of varying profile). In the embodiment illustrated, the thickness of the first layer(s) 30 (which in this embodiment includes any other layer which lies between the first layer(s) 30 and the filter layer 36) varies, so that the undersurface thereof (which is adjacent the upper surface of the filter layer 36) is planar and the thickness of the filter layer 36 is preferably constant. Alternatively the thickness of the first layer(s) 30 may be constant and undulating, in which case the filter layer 36 undulates and follows the profile of the first layer(s) 30. As a further alternative, the profile of the filter layer 36 may vary in a different manner to that of the first layer(s) 30.

The watermark formation element 20 may have one set of front surface apertures 23 which define one shape, and another set of front surface apertures 23 which define a different shape. The first set may be located within the second set.

In these examples, where the shape of the drainage surface apertures 24 define a particular shape or set of shapes, the watermark formation surface 21 in the watermark forming section 52 does not need to be contoured, although it may be.

Figure 25:
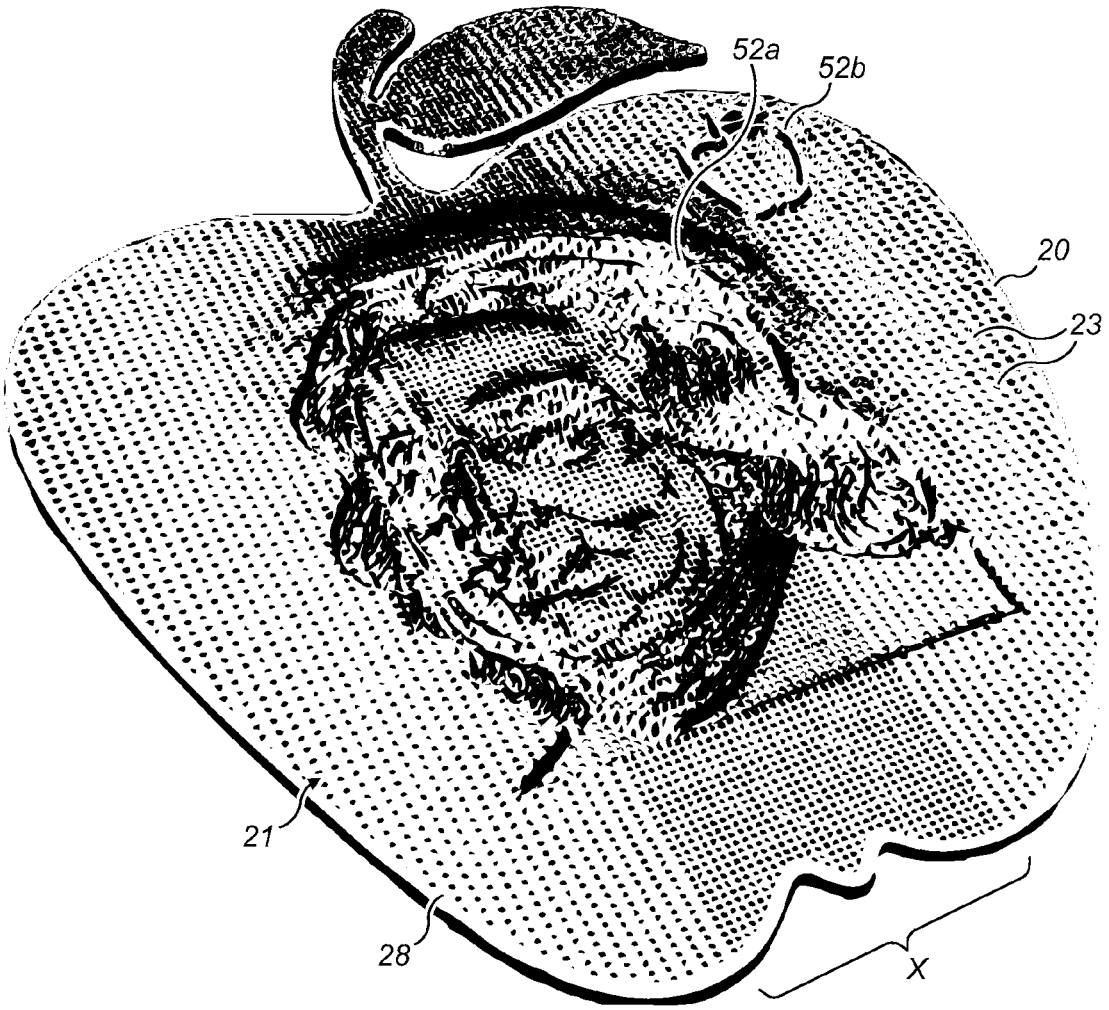
FIG. 25 is a further alternative watermark formation element.

In addition to selecting a particular shape of the front surface apertures 24, the watermark formation element 20 may be of a particular shape. For example, as shown on FIG. 25, the watermark formation element 20 has the shape of an apple. The shape of the front surface apertures 24, the shape of the watermark formation element 20 and/or the watermark formed may also be selected to be the same as, or related in context to each other. Thus in the example or FIG. 25, the drainage surface apertures 24 and the watermark formation element 20 are in the form of apples, whilst the watermark is a portrait of Sir Isaac Newton. Other shapes related in context could include an emblem or geographical outline of a country and the letters indicating its currency; the nature of a currency and numerals indicating its value; the geographical outline of a country and images from its flag, e.g. Ghana and star, Sri Lanka and lion with sword, Pakistan and crescent moon; portraits and quotations or identifying symbols, e.g. Churchill and the phrase "fight them on the beaches", Lincoln and extract from the Gettysburg address, Washington or Franklin and declaration of independence, Jane Austen and quill pen. The shape of the watermark formation element 20 may be a symbol, a pictorial image, an alphanumeric or a geometric or non-geometric shape. In this example a first watermark forming section 52*a* forms a pictorial watermark having light and dark shades, in the form of a head. The watermark formation element 20 may have a border provided by larger solid areas 28. These may provide a suitable means of anchoring the watermark formation element 20 to the face cloth 11. A second watermark forming section 52*b* is provided which forms an electrotype type of watermark in the shape of an apple which has just light shades.

Where such a shaped watermark formation element 20 is attached to the face cloth 11 of a cylinder mould cover, the finished paper manufactured thereon may have two different "wire marks". When a web of substrate is formed using a cylinder mould cover, the profile of the mesh of the face cloth 11 produces what is known as a "wire mark" across the entire web. Generally, where the warp wires (in the machine direction) and weft wires (in the cross direction) cross, a knuckle is formed which is slightly raised relative to the warp and weft wires. The knuckles cause a very minor variation in the density of the substrate fibres which are deposited on the surface of the mould cover. The imprint of the face cloth 11 also causes a barely perceptible undulation of the surface of the finished substrate and a regular pattern throughout the substrate which is virtually indistinguishable to the unaided eye. Where a watermark formation element 20 is attached to the face cloth 11, The finished paper will have one wire mark formed by the mesh of the face cloth 11 and another formed by any regular pattern formed by front surface apertures 23 and solid areas 27 watermark formation element 20.

Figure 28B:
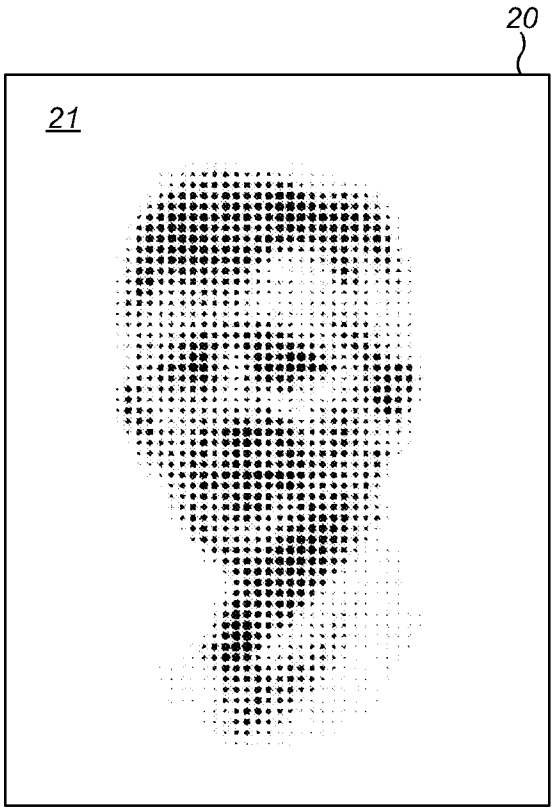
Figure 28A:
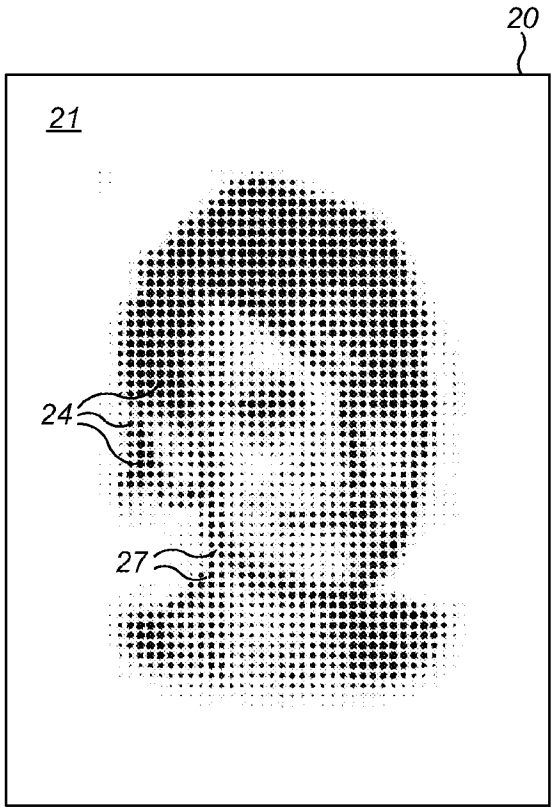

As mentioned briefly above, the drainage rate can be controlled by a number of different means (either alone or in combination) and this can be used to provide tonal variation within the watermark(s). The size and/or shape of the drainage surface apertures may be varied to achieve this. Some examples of watermark formation elements 20 used to form a watermark in the form of a portrait are illustrated in FIGS. 28*a* and 28*b*. The watermark formation surface 21 in each of these examples does not have to be contoured (although it may also be contoured) as the size of the drainage surface apertures 24 varies to provide the tonal variation. In these examples the drainage surface apertures 24 have the same circular shape, although the shape may be varied. The size of the solid areas 27 between the drainage surface apertures 24 also therefore varies.

The drainage surface apertures 24 may positively define a shape (such as the circle in FIGS. 28*a* and 28*b*) or they may negatively define a shape (so that the solid areas 27 therebetween positively have that shape). Alternatively the watermark forming section 52 may have drainage surface apertures 24 some of which positively define a shape and some of which negatively define the same shape.

In the example illustrated in FIG. 28, the drainage surface apertures 24 have a circular shape. However a tonal variation can be achieved by varying the shape and/or size of symbols, pictorial images or alphanumeric shapes. For example in the case of the drainage surface apertures 28 having a shape of a letter, then the areas of the watermark formation element 20 which form the darker regions in the final halftone image in the watermark would have a larger stem width than the drainage surface apertures 24 forming the lighter part of the halftone image.

The spacing between the front surface apertures 24 can also be varied to provide tonal variation. Thus in the finished paper, the areas formed by the regions of the watermark formation element 20 in which closer spaced front surface apertures 24 are located are darker than the areas formed by the areas in which the front surface apertures 24 are more widely spaced. In the example illustrated in FIG. 25, there is a central band X in which the front surface apertures 24 are closer together than those lying on either side of the band X.

Figure 26:
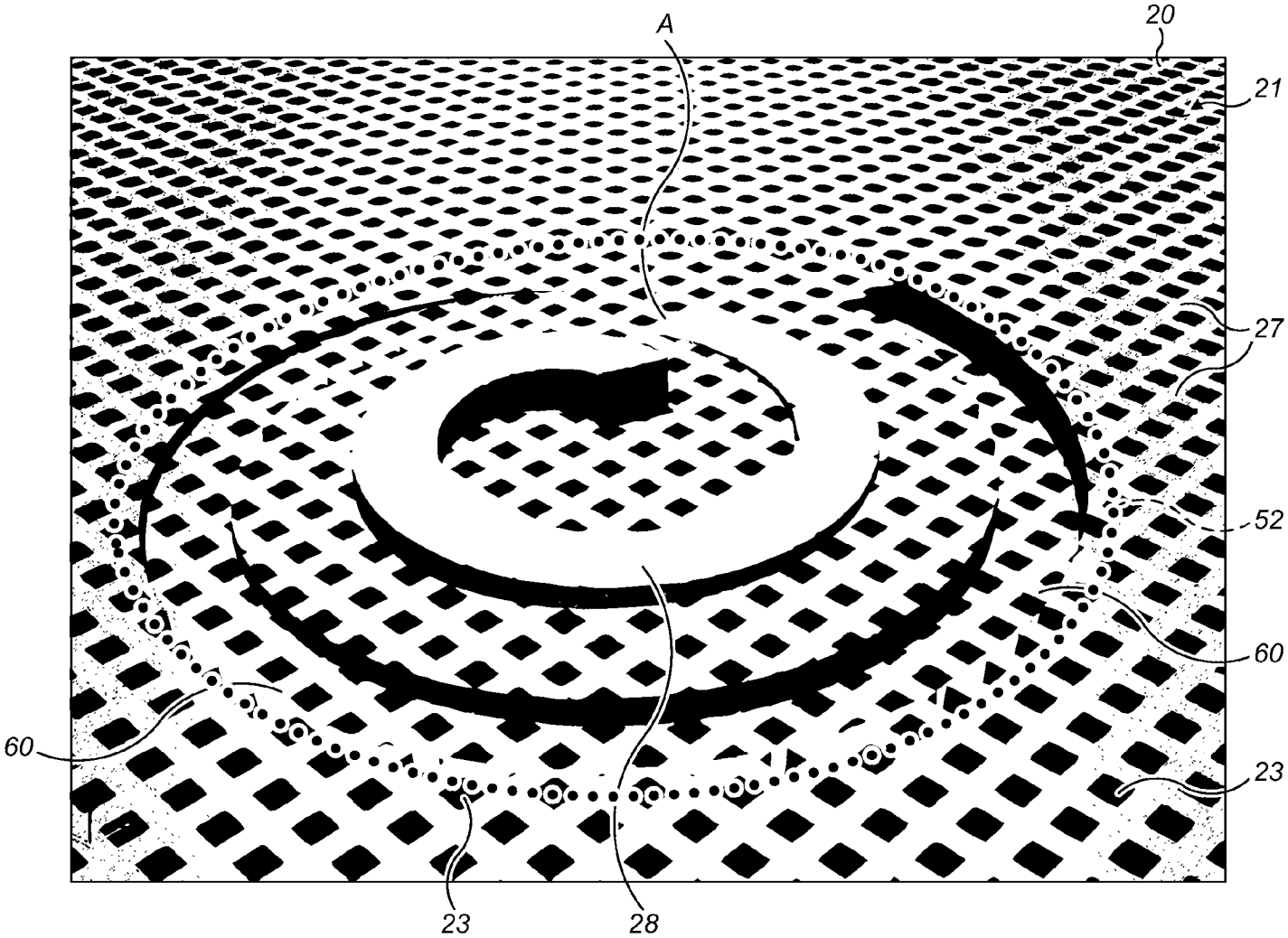

Such watermark formation elements 20 can be used to provide a continuous variation in the tone of the watermark from one section (preferably an end or an edge) thereof, which has the lightest tone, to an opposing section (preferably the other end or opposing edge), which has the darkest tone. This can be achieved using any of the aforementioned methods of carrying the tone, such as by varying the height/depth of at least one watermark forming section 52 of the watermark formation surface 21 or by varying the apertures or a combination of both. One example of this feature is illustrated in FIG. 26. In this example, the watermark forming section 52 is configured to produce at least one watermark in the finished paper which is a continuous spiral and has a continuous tonal graduation from one end of the spiral, which is the darkest region, to the other end, which is the lightest region. The light end of the spiral is produced by larger solid areas 28 which are raised relative to the "normal" level (i.e. that of the non-watermarking sections of the watermark formation surface 21), gradually reducing in height at a continuous rate until the normal level of the watermark formation surface 21 is reached, i.e. the level of the non-watermark forming sections. This is marked as point A on FIG. 26. At this point the watermark forming surface 21 starts to drop below the normal level, forming a channel 60 which increases in depth at a continuous rate. The deepest end of the channel (i.e. at the other end of the spiral) produces the darkest region of the spiral.

Such watermark(s) which has (have) a continuous tonal variation are preferably in the form of a continuous line or band which may be straight, curved and which may change direction e.g. a single straight line, an arc, a spiral, a zig-zag or the like and which clearly have opposing ends. Such a watermark can provide a convenient method of checking for counterfeits in that it comprises all multi-tones from light to dark within a single watermark in a continuous graduation.

In one example, the preferred grammage of the finished paper in the darkest region of the watermark is at least 140% of the grammage of the non-watermark regions. Thus in one preferred example for 100 gsm background paper this would be approximately 140 gsm, and for 90 gsm background paper it would be approximately 126 gsm. However these regions could have a heavier grammage still, preferably at least 160%, or more preferably at least 180%, of the grammage in the non-watermarked regions. The lightest region of the watermark, the grammage is preferably no more than 50% of the grammage in the non-watermarked regions, more preferably no more than 40% and more preferably still no more than 25%. Thus in one preferred example for 90 gsm background paper, the grammage in the lightest region is 20 gsm.

Thus for a 90 gsm paper the grammage may range from approximately 20 gsm to up to approximately 200 gsm.

One technique for measuring grammage is as follows. A radiograph is generated by exposing a sample sheet to a beta ray source (C-14) and recording the radiation transmitted through the sheet on an X-ray film. The developed film is scanned with a flat-bed scanner, and the grey levels of the image are transformed to actual grammage values through a calibration scale obtained from a sample of known grammage.

The watermark formation element 20 may also be configured to produce such a continuously graduated watermark located adjacent another watermark, which provides another convenient anti-counterfeit check. The continuously graduated watermark provides a reference chart, in that its darkest end matches the darkest regions in the adjacent watermark, and the lightest end matches its lightest regions. The continuously graduated watermark also has the colour of the base paper in the middle.

Figure 27:
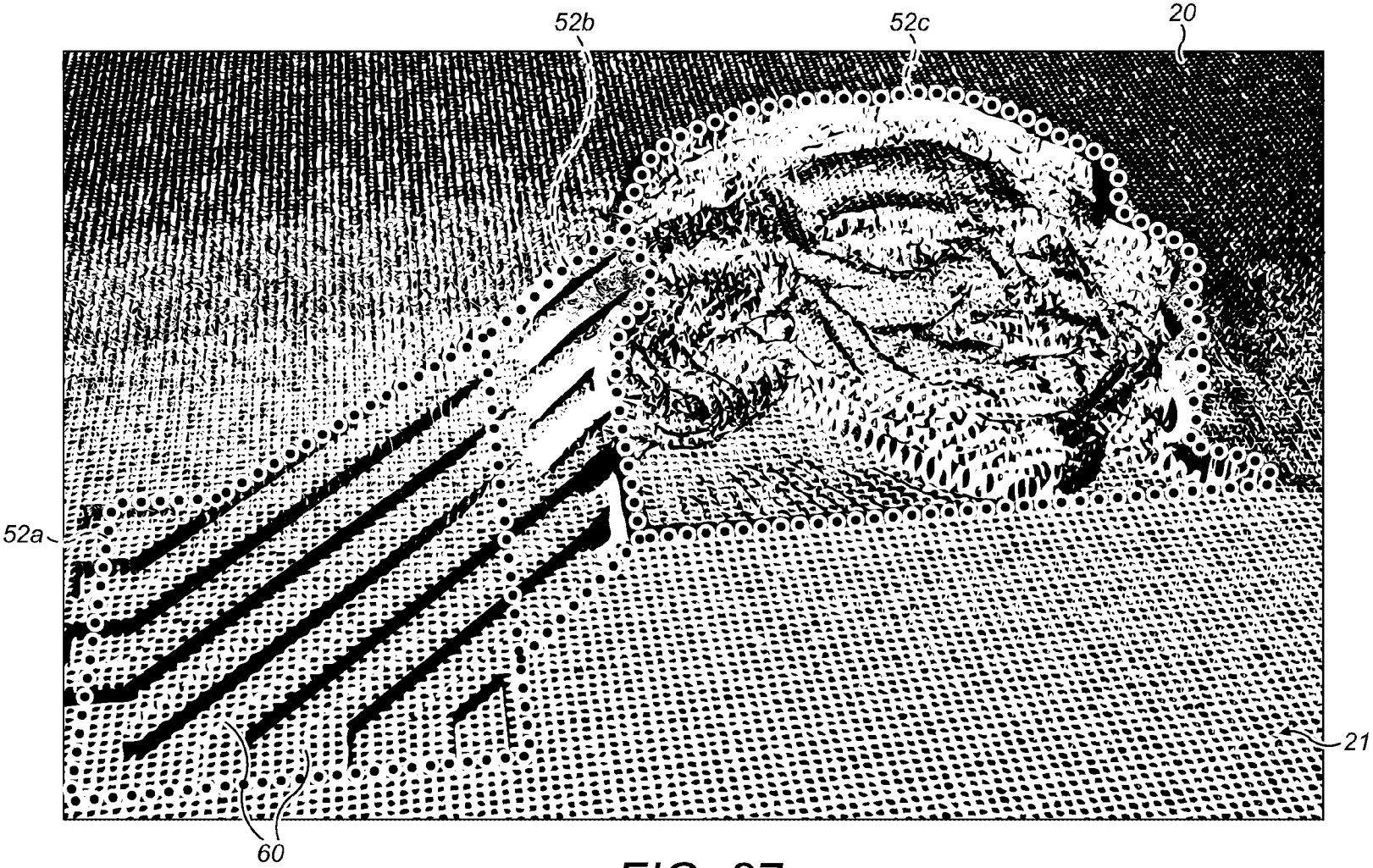

The watermark formation element 20 may also be configured to produce such a continuously graduated watermark which blends into another watermark. In the example shown in FIG. 27, in one area of the watermark formation element 20, a first watermark forming section 52*a* produces corner reinforcing watermarks of the type known from EP-A-1468142, which has just darker shades formed by channels 60 having a constant depth. A second watermark forming section 52*b* is formed adjacent the first watermark forming section 52*a*, which is configured to provide a continuous tonal graduation from the end of the channels 60 to a pictorial watermark in a third watermark forming section 52*c*.

The watermark formation element 20 may also be configured to produce such a continuously graduated watermark which has text or patterns within the continuous band or line. These may be darker and/or lighter regions.

The watermark formation element 20 may be formed from a plurality of separate layers, especially if formed using a 3D printing process as described below. However in the finished watermark formation element 20 these layers may be integrally fused together and indistinguishable as separate layers. The layers are formed with apertures, which combine to form the drainage channels 22. The apertures in the top layer(s), which form the watermarking forming surface 21, preferably have a smaller cross sectional area than those in the bottom layer(s), which form the drainage surface 25. However they may alternatively have a larger cross sectional area or the same cross sectional area.

In one example, as shown in FIGS. 6*a* to 6*e*, there are pluralities of first layers 30, second layers 31, third layers 32 and fourth layers 33. Each of the first layers 30 are provided with apertures of one size, which form the front surface apertures 23. Each of the second layers 31 are provided with apertures 34 which have a larger cross sectional area than the front surface apertures 23. Each of the third layers 31 are provided with apertures 35 which have a larger cross sectional area than the apertures 34 in the second layers 31. Each of the fourth layers 31 are provided with apertures which have a larger cross sectional area than the apertures 35 and which form the drainage surface apertures 24.

Although the illustrated example shows four of each of the four layers 30,31,32,33, the number of layers forming the watermark formation element 20 is not restricted and the number of identical layers may also vary.

The apertures 23,34,35,24 in the different layers may have the same cross sectional shape as each other, albeit with different cross sectional areas or the shape may be varied from layer to layer.

The cross sectional area of the apertures 23,34,35,24 in any one layer may also be varied, with larger apertures 23,34,35,24 providing increased drainage and fibre deposition over smaller apertures 23,34,35,24.

The total cross sectional area of the front surface apertures 23 is preferably between 1% and 40% of the total surface area of the watermark formation element 20, more preferably between 5% and 30%, and more preferably still between 15% and 25%.

The layers 30,31,32,33 illustrated in FIGS. 6*a*-6*d* and 7*a*-7*d* are shown as planar. However the layers may be non-planar, for example curved in one or more directions.

The drainage rate through the watermark formation elements 20 can additionally be controlled by the open area and mean open diameter of the openings in the wire cloth 10 (or other foraminous surface), which provides the supporting structure. The mean diameter of the openings is preferably between 0.02 and 0.4 mm and more preferably between 0.05 and 0.1 mm. The wire cloth 10 (or other foraminous surface) is preferably produced by a method that is not constrained by the rate of change of gradient of the watermark forming surface 21. This enables improved resolution and contrast to be archived.

The drainage rate through the watermark formation elements 20 can further be controlled by spraying, coating or otherwise covering the watermark formation surface 21 with a material which changes the hydrophobic property of the material from which the watermark formation element 20 is made. The hydrophobicity can be controlled by printing the watermark formation element 20 with two or more different materials with different, possibly widely varying, hydrophilic or hydrophobic natures which have different surface energies/contact angles. For instance, if the wax support material (hydrophobic, non wetting) is not fully removed from the 3D printed element, then water does not drain readily through some drainage channels 22. This is because the contact angle of the water droplet is too great and the droplet that forms will not pass through the drainage channels 22. As a result, fibre is not deposited in that area to the same extent as more hydrophilic areas and a highlight ensues. Thus if two constructional polymers are used to form different areas of the watermark formation element 20, one more hydrophobic than the other, although the size of the drainage channel 22 may be uniform across the area, where a hydrophobic material is used then less fibre will be deposited and so the image density can be modulated.

Equally it may be possible to adjust the drainage in some areas by coating, painting, printing or spraying the desired area with a hydrophilic resin to encourage drainage through wetting, or a hydrophobic material to discourage drainage.

Figure 7A:
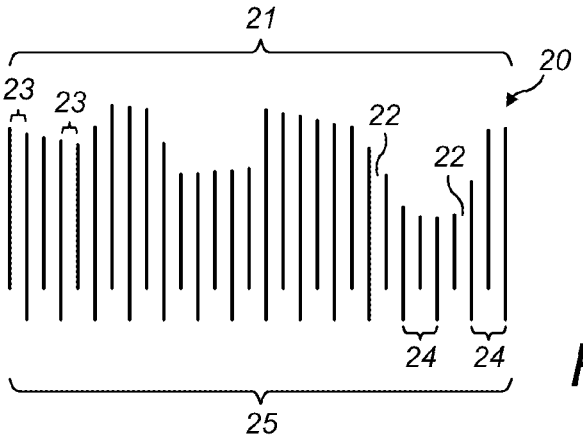
FIGS. 7*a* to 7*d* illustrate the construction of a further alternative watermark formation element.
Figure 7B:
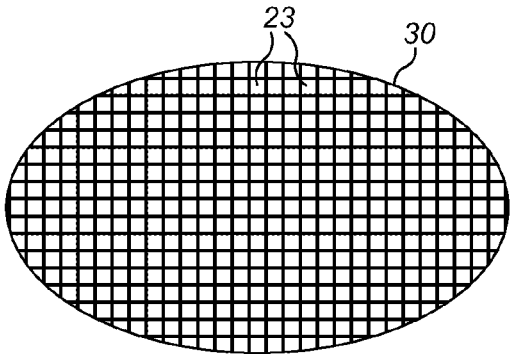
Figure 7C:
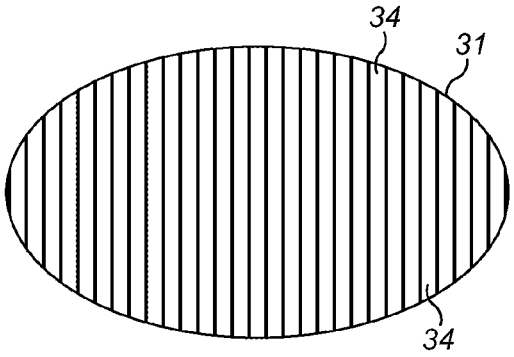
Figure 7D:
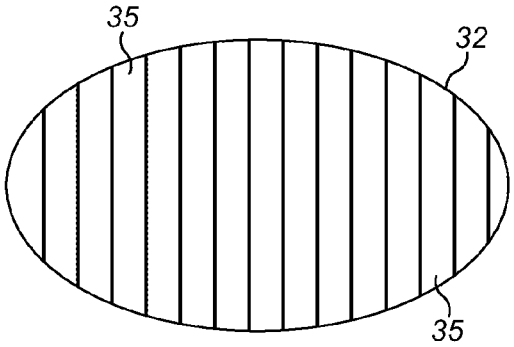

The structure of the watermark formation elements 20 may also be designed to allow sideways (lateral) drainage of liquid below the watermark forming surface 21, one example of which is shown in FIGS. 7*a* to 7*d*. The first layer 30, which forms a substantial portion of the watermark forming surface 21, has a mesh like construction with square front surface apertures 23. The underlying second layer 31 is provided with apertures 34 in the form of channels extending across from one edge of the layer 31 to an opposing edge. The third layer 32, which in this embodiment forms the drainage surface 25, is also provided with apertures 35 in the form of channels extending across from one edge of the layer 31 to the other in a similar direction to those of the second layer 31. The channels of the third layer have a greater width to those of the second layer 31. This structure produces a watermark formation element 20 having a cross section as shown in FIG. 7*a*. Thus in addition to the drainage channels 22 which extend through the watermark formation element 20 from the watermark formation surface 21 to the drainage surface 25, one or more additional drainage channels are provided which extend laterally within the watermark formation element 20 beneath the watermark forming surface. These laterally extending drainage channels may extend from one side of the watermark formation element 20 to another as shown in FIGS. 7*a*-7*d*. Alternatively they may simply extend from one point on the perimeter of the watermark formation element 20 to another point. These drainage channels may be straight, angled, curved or any other suitable shape, and may extend in the machine or cross-direction. The lateral drainage channels may lie in a single plane (or layer 30-33) or they may be stepped across two or more layers 30-33.

Although the watermark formation element illustrated in FIGS. 7*a*-7*d* is described as having single first, second and third layers 30,31,32 the same may apply where each of the 30,31,32 is formed from a plurality of layers described previously. Additionally, although the illustrated example shows three layers 30, 31, 32, the number of layers forming the watermark formation element 20 is not restricted. Furthermore, different layers from those shown may have the laterally extending apertures 35.

The watermark formation elements 20 described above can therefore combine the advantages of contour formed watermarks (embossed cylinder mould watermarks) and restricted drainage formed watermarks (electrotype watermarks) to obtain greater contrast between the light and dark areas of a watermark and very light areas. They also relieve a number of the design constraints arising from cylinder mould and electrotype watermarks, in particular:—

- unlike with the usual electrotype method, the watermark formation elements 20 can be used to form any part of the watermark;
- the watermark formation elements 20 are not limited to specific dimensions in order to obtain good clarity and contrast compared to the background, as are traditional electrotypes. The use of such watermark formation elements 20 allows for a greater range be used more flexibly in order to achieve a greater range of artistic effects. In particular the electrotype image contrast can be reduced by reducing the thickness if such an effect is desirable from an aesthetic point of view. Such subtleties may also contribute to enhanced security by increasing the complexity of the image tonality;
- where the finished document requires a combination of cylinder mould and electrotype watermarks, the location of the electrotypes relative to the embossings has always been constrained because of the manufacturing issues and problems described previously. These no longer apply as a single watermark formation element 20 may be used to provide equivalent watermarks. This does not apply to the watermark formation elements 20 of the present invention as it is possible to create deeper areas within the profile of the watermark formation surface 21 and provide solid areas within the deeper areas, as well as in the higher areas;

in a traditional process which has electrotypes, there is a manufacturing, and therefore design, constraints on the number of electrotypes per mould cover and their location. This is because they are usually attached using a robotic arm, which is a time consuming process.

The use of watermark formation elements 20, as opposed to embossing the wire cloth 10 of the cylinder mould cover or attaching electrotypes thereto, provides the ability to produce complex multitonal designs or images can be created with sharply contrasting dark and very light areas adjacent each other. However it brings a number of additional manufacturing challenges.

Durability of the resulting cylinder mould cover is extremely important as it is subjected to significant stresses. The stresses may result from a couch roll, dandy roll or the felt (formex) depending on the configuration of the paper machine. In a machine which uses a couch roll, for example, the couch roll rotates in contact with the cylinder mould and is used to transfer the partially formed paper web from the cylinder mould cover to the felt (formex) which carries the web from the wet end of the papermaking machine to the press section. There is therefore a significant pressure formed between the cylinder mould and the couch roll. This means that, where there is any element protruding from the surface of the wire cloth 10, there will be a constantly repeating additional stress to the wire cloth 10.

The watermark formation elements 20 may also be provided with shock absorbing properties, which enable the watermark formation element 20, and therefore the cylinder mould cover, to withstand the pressure from the couch roll. This may be achieved by making the whole, or a part, of the watermark formation element 20 from a resilient material, such as rubber.

Alternatively, the watermark formation element 20 may comprise a support layer 40, as an additional layer to those described previously, at the back of the watermark formation element 20 either behind or forming the drainage surface 25. For example, referring to the previously described embodiments, the support layer 40 may be located on the back of the fourth layer(s) 33 in FIGS. 6*a*-6*e* or the third layer 32 in FIGS. 7*a*-7*d*.

Alternatively the support layer 40 may be one or more of the layers 30,31,32,33 of these previously described embodiments.

Figure 8:
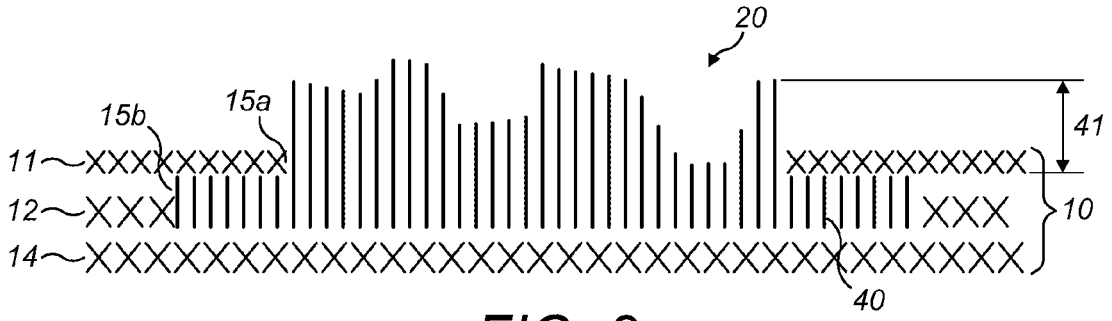
FIGS. 8 to 17 are cross sectional side elevations of yet further alternative watermark formation elements attached to the wire cloth of a cylinder mould cover.
Figure 9:
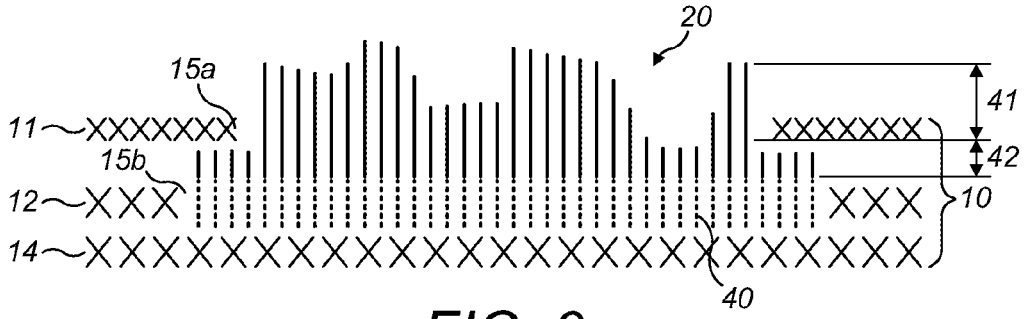

The support layer 40 may be made from a resilient material. In the embodiment shown in FIG. 8, the support layer 40 is an additional layer located at the back of the watermark formation element 20. The support layer 40 may be attached to the watermark formation element 20 by any suitable means, for example UV cured resin Alternatively the support layer 40 may have a structure which is resilient. In the embodiment shown in FIG. 9, the support layer 40 is located at the back of the watermark formation element 20. The support layer 40 is formed from a series of springs (which may be leaf, volute, coil, zigzag or other types of spring configurations).

Alternatively the support layer 40 may have a honeycomb or tessellated structure.

It is important that the support layer 40 has a shape and/or configuration which does not interfere with the drainage flow through the drainage surface 25 of the watermark formation element 20 or the backing layer(s) of the wire cloth 10. In any of these embodiments, the support layer 40 must therefore have apertures which ensure that the support layer 40 does not interfere with the drainage requirements identified above and/or which form part of the drainage channels 22.

Figure 10:
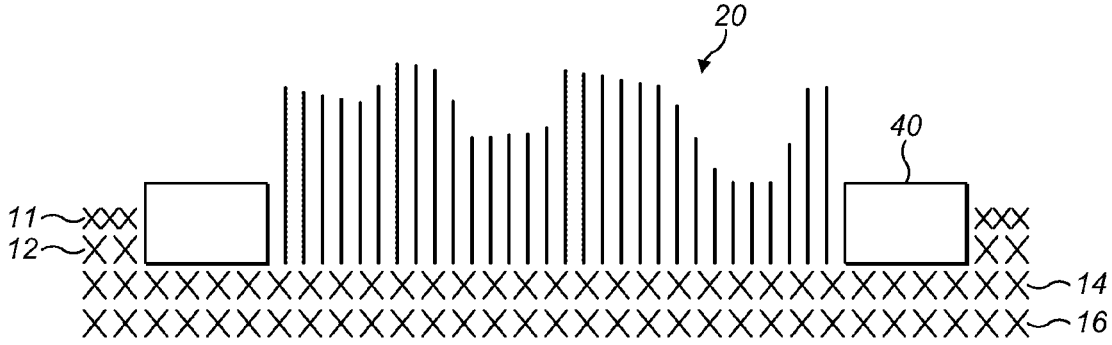

In a further alternative construction (see FIG. 10), the watermark formation element 20 comprises an annular resilient support layer 40 which extends around the circumference of the watermark formation element 20.

Figure 11:
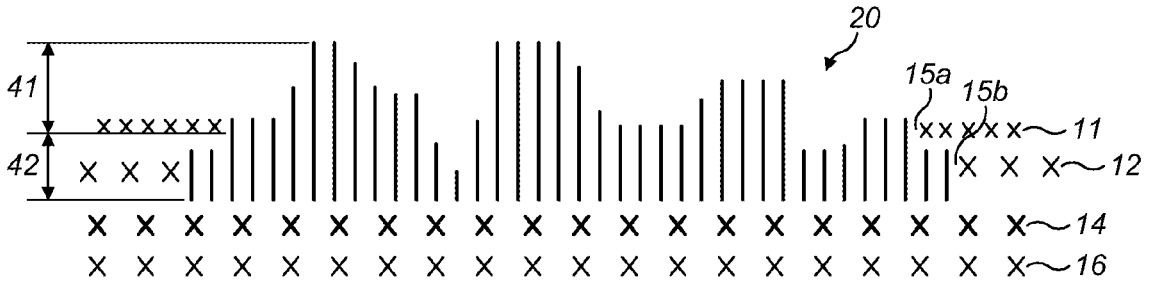

The method used to locate and/or attach one or more of the aforementioned watermark formation elements 20 to the wire cloth 10 is also an important factor in ensuring the durability of the cylinder mould cover. The following description refers to the location/attachment of a single watermark formation element 20 to the wire cloth 10. In the embodiment illustrated in FIGS. 8, 9 and 11, the wire cloth 10 is formed from a face cloth 11, first backing layer 12, a second backing layer 14 and, in the case of FIG. 10 only, a third backing layer 16. The face cloth 11 and first backing layer 12 each have a cut out area 15*a*, 15*b* respectively. The cut out area 15*a* in the face cloth 11 is smaller than that in the first backing layer 12 and is substantially the same size as, or slightly larger than, an upper section 41 of the watermark formation element 20. This allows the upper section 41 to pass through the cut out area 15*a*. The support layer 40 of the watermark formation element 20 and/or a lower section 42 of the watermark formation element 20 has at least one cross sectional dimension which is greater than that of the cut out area 15*a* in the face cloth 11, but is the same or slightly smaller than the cut out area 15*b* in the first backing layer 12. This enables the watermark formation element 20 to be anchored between the layers of the wire cloth 10. The rear surface of the watermark formation element 20 (whether this is the drainage surface 25 or the support layer 40) is located against, and supported by, the second backing layer 14.

Figure 12:
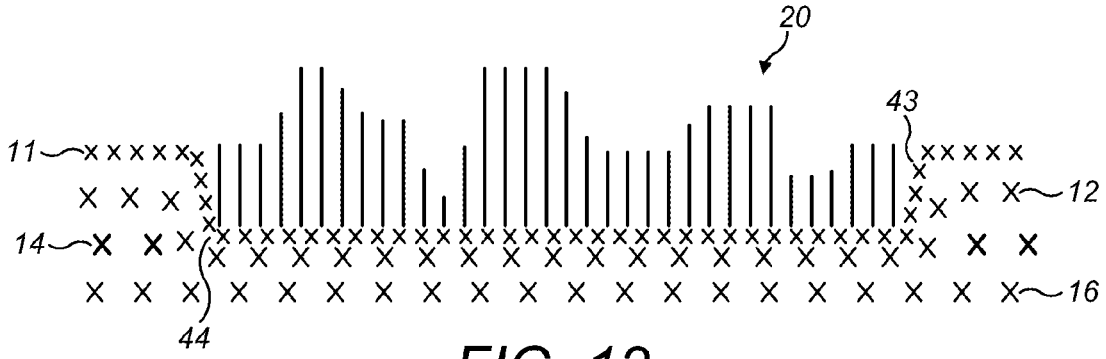

Alternatively a watermark formation element 20 may be at least partly located in a recess 43 in the face cloth 11 of the cylinder mould cover as shown in FIG. 12. The recess 43 is preferably formed by embossing the face cloth 11 (and possibly also the underlying first backing layer 12). The recess 43 is preferably shallow (for example between 0.5 mm and 2 mm deep). The recess 43 is preferably arranged so that the watermark formation element 20 is pushed up against a locating corner. The watermark formation element 20 is thus protected by the surrounding walls of the recess 43.

Figure 13:
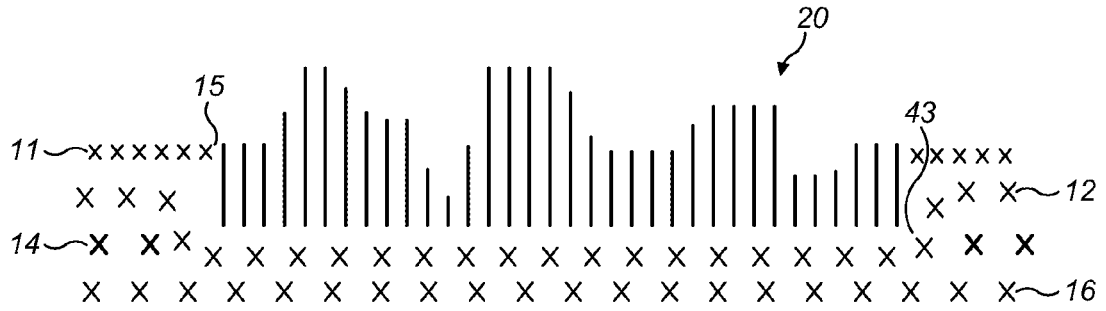

FIG. 13 shows an alternative arrangement in which the face cloth 11 is provided with a cut out area 15 (similar to the cut out area 15 illustrated in FIGS. 8 and 9) through which a watermark formation element 20 projects. The first backing layer 12 is provided with a recess 43 in which a watermark formation element 20 may be at least partly located.

These are not the only suitable constructions. In other variations, some or all of the layers of the wire cloth 10 may be provided with cut out areas 15 and/or recesses 43.

One or more watermark formation elements 20 may also be attached to one or more layers of the wire cloth 10. Suitable methods of attaching a metallic watermark formation element 20 to the wire cloth 10 are resistance or laser welding and soldering. Plastic welding may be used to attach polymeric watermark formation elements 20. Alternatively, the watermark formation element(s) 20 may be sewn, for example with a fine wire, onto the wire cloth 10. The watermark formation element(s) 20 may also be adhered to the wire cloth 10, for example with a UV cured resin or another suitable adhesive.

One or more fixings 45 may be used to attach one or more watermark formation elements 20 to one or more layers of the wire cloth 10. Such fixings 45 may be threaded metal inserts, weldable metal inserts, flanged plastic or metal components, staples, components with bendable legs and so on. The fixings 45 are preferably porous or hollow (e.g. tubular).

Figure 14:
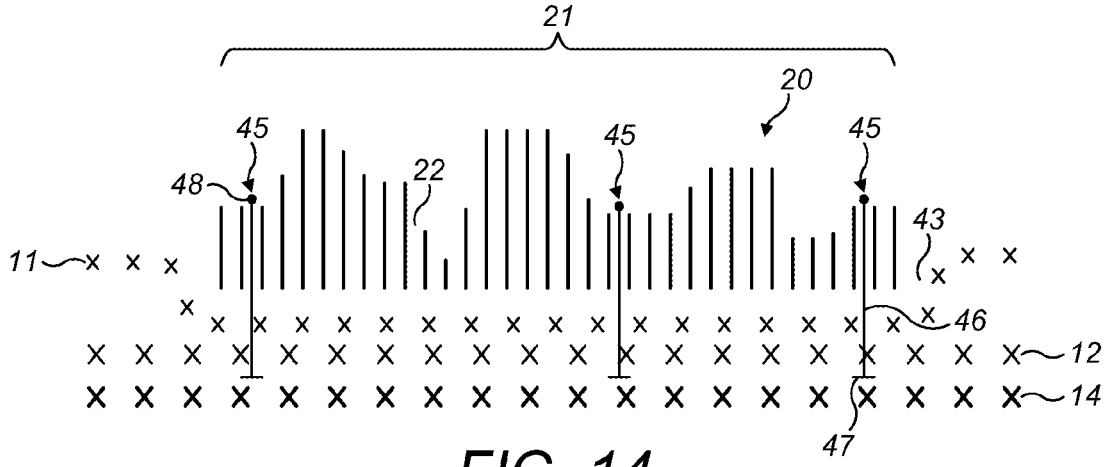

FIG. 14 illustrates one type of suitable fixing 45. This comprises a shank 46, which may be a wire or plastic filament or an elastic thread, which passes through one or more layers of the wire cloth 10 and a drainage channel 22 of the watermark formation element 20. One end of the shank 46 has foot 47 integrally formed thereon or attached thereto. The foot 47 may at least one dimension greater than that of the wire mesh opening in the rearmost backing layer to which the fixing 45 is attached, in the illustrated example first backing layer 12. The opposite end of the shank 46 is threaded through the drainage channel 22 and a head 48 is attached thereto or formed thereon. The size of the head 48 is greater than the size of the front surface aperture 23 of the drainage channel 22 to ensure that the watermark formation element 20 is held securely in position. One or more fixings 45 may be used per watermark formation element 20.

Figure 15:
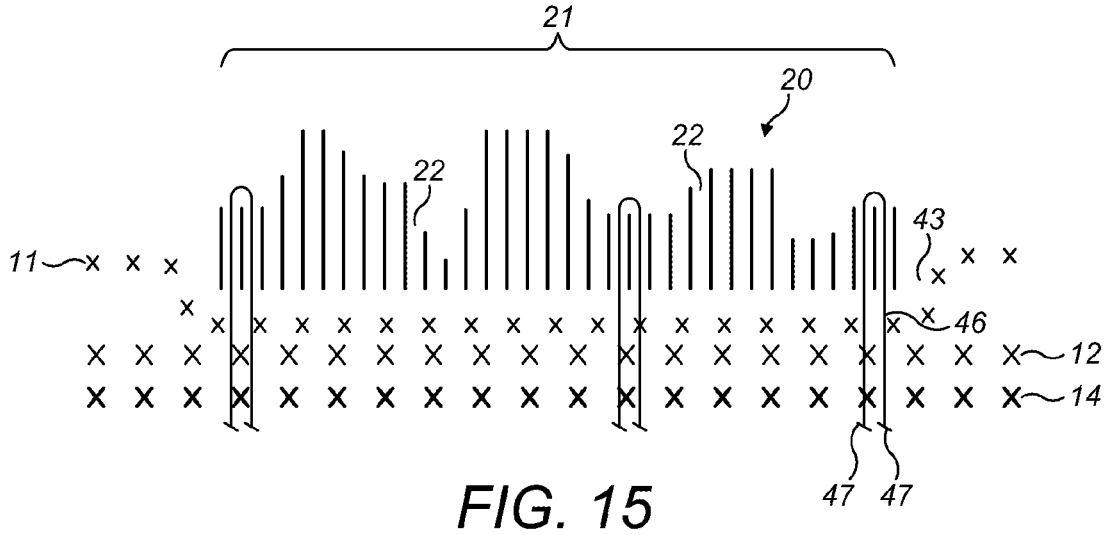

FIG. 15 illustrates the use of another form of suitable fixing 45. This has a flexible shank 46, which may be a wire or plastic filament or an elastic thread. The shank 46 passes through one or more layers 11,12,14,16 of the wire cloth 10, up one drainage channel 22, across the watermark formation surface 21, down an adjacent drainage channel 22. And back through the one or more layers 11,12,14,16 of the wire cloth 10. Feet 47 are formed on, or attached to, each end of the shank 46, which feet 47 have at least one dimension greater than that of the wire mesh opening in the rearmost backing layer to which the fixing 45 is attached.

Figure 16:
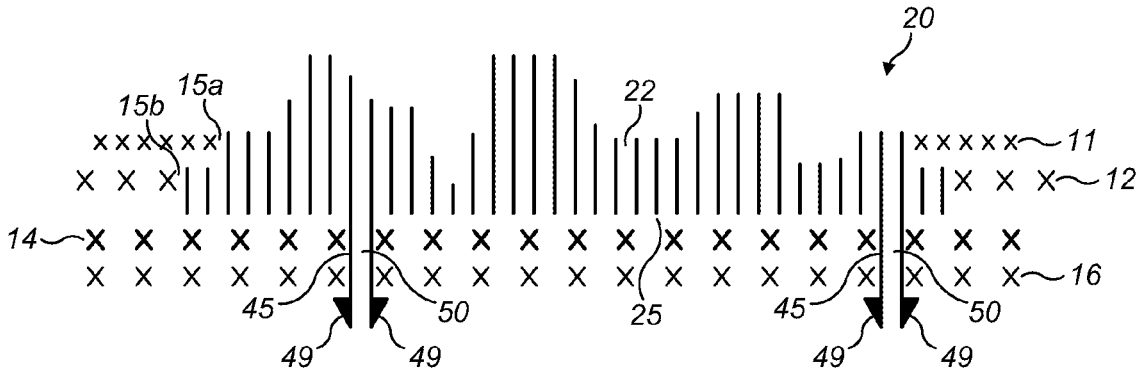

FIG. 16 illustrates the use of yet another suitable form of fixing 45. This comprises a tubular or porous barbed spigot which extends from the drainage surface 25 of the watermark formation element 20 through one or more layers of the wire cloth 10. In the illustrated embodiment, the watermark formation element 20 is located in cut out areas 15*a*, 15*b* in the face cloth 11 and first backing layer 12, so the spigot is pushed through the wire mesh openings in the second and third backing layers 14,16. The spigot has a central drainage passage 50 and its distal end is provided with one or more barbs 49 which hook on the wire of the rearmost backing layer through which the spigot passes; in the illustrated embodiment this is the third backing layer 16.

Figure 17:
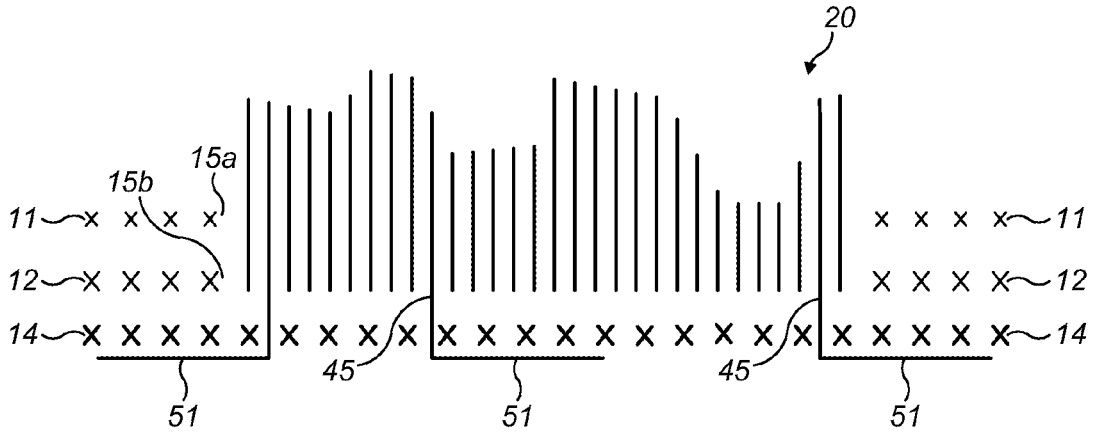

FIG. 17 illustrates the use of yet another suitable fixing 45. This is in the form of a wire which extends from the drainage surface 25 of the watermark formation element 20 through one or more layers of the wire cloth 10. In the illustrated embodiment the watermark formation element 20 is located in cut out areas 15*a*, 15*b* in the face cloth 11 and first backing layer 12, and the wire is threaded through a wire mesh opening in the second backing layer 14. The end of the wire is bent over to form a hook 51.

The aforementioned fixings 45 may additionally be adhered or welded to the wire cloth 10 to ensure that they are firmly attached.

To enable the attachment of the watermark formation element 20 to the wire cloth 10 by means of fixings, one or more of the layers forming the wire cloth 10 may need to be provided with additional or larger holes for receiving the fixings 45.

The aforementioned watermark formation elements 20 can be produced by 3D printing or another suitable manufacturing process, such as injection moulding, laser ablation, vacuum formation, machining etc.

3D printing, also known as rapid prototyping or additive manufacturing, is a relatively new technology, which uses a digital model, usually created by some form of computer aided design (CAD) package or a 3D scanner, to create a 3 dimensional object. The 3D printer reads the data from the CAD drawing and lays down successive layers of material to build up a physical object from a series of cross sections. There are a large number of different 3D printing processes, including (but not limited to) stereolithography (SLA), Selective Laser Sintering (SLS), Selective Laser Melting (SLM), Laminated Object Manufacturing (LOM), Fused Deposition Modelling (FDM), Solid Ground Curing (SGC), Direct Metal Laser Sintering (DMLS), electron beam melting (EBM) and ink jet printing techniques.

3D printing methods may be used to manufacture the watermark formation elements 20 from a variety of materials. Examples include one or more polymeric materials, one or more metals or a combination of both metals and polymers, for example with a metal incorporated into a polymer matrix. The material or materials selected for the watermark formation elements 20 need to be sufficiently durable to with stand the pressure created between the cylinder mould and the couch roll and the continuous percussion therefrom. The selection of the material(s) will also depend on the 3D printing process used.

Some examples of suitable polymeric materials are given below, although this list is not exhaustive:—

For fused deposition manufacture (FDM):
acrylonitrile butadiene styrene (ABS)
polyphenylsulphone (PPS, PPSU or PPSF)
polylactic acid (PLA)
polyamide (PA)
polycarbonate (PC)
blends of materials, for example PC-ABS
For selective laser sintering (SLS):
Nylon, notably PA12
glass filled PA12
For inkjet or 'photojet' type processes (UV curing resins):
acrylic
simulated ABS
simulated polypropylene(PP)
rubber like grades
dental grades
biocompatible grades Some examples of suitable metals are given below, although this list is not exhaustive:—

For selective laser sintering (SLS) or selective laser melting (SLM) of metal powders:
titanium, pure and alloys
Steels, including stainless steels
nickel-chromium alloys
aluminium, pure and alloys
cobalt-chromium alloys
copper and copper alloys Advantageously watermark formation elements 20 comprising more than one different material can be formed using a single device, such as a 3D printer, as some commercial 3D printers e.g. Stratasys' Objet 350 Connex model, are able to print multiple materials. This enables both multi-coloured products and composite structures, e.g. combined rigid and rubberlike polymers, to be produced in a single process.

A significant advantage of using a 3D printing process to form the watermark formation element(s) 20 is that the time taken to manufacture a cylinder mould cover, and therefore the cost, is significantly reduced compared to the traditional process, as the artwork is used directly to form the watermark formation elements 20. There is no longer a need to produce embossing dies, which must then be used to emboss the cylinder mould cover. The use of a computer controlled process for forming each individual watermark formation element 20 makes it possible to customise each individual watermark, for example for unique passport pages or banknote serial numbers.

A further advantage of 3D printing is that it makes it considerably easier to accommodate shrinkage. As the paper web passes through the various stages of the papermaking process, it shrinks. The degree of shrinkage at the edge of the paper web is greater than in the centre and may vary according to the particular machine, wetness, type of stock processing speed used. To get a uniform finished document width, the actual document width on the cylinder mould cover during manufacture has to vary to compensate for shrinkage. The design of any watermark must also allow for shrinkage. Using 3D printing means that the watermark formation elements 20 can easily be adjusted, depending on where on the width of the cylinder mould cover they are located.

Another advantage of 3D printing is that many of the methods described above can be used to form the watermark formation elements 20 directly on the wire cloth 10 of the cylinder mould cover with no need for additional fixings 45.

Alternatively one or more watermark formation elements 20 may be formed onto a section of wire mesh which is subsequently attached to the wire cloth 10, for example to the face cloth 11, of the cylinder mould cover with suitable fixings 45.

3D pens are also available, such as 3Doodler™ or Lixpen™. These can be used to attach the watermark formation elements 20 to the wire cloth 10 by drawing loops from a 3D printed watermark formation element 20 around the wires of the face cloth 11 and back to the watermark formation element 20. Such 3D pens may also be used with the watermark formation elements 20 which have been manufactured by a method other than 3D printing.

As another alternative, the watermark formation elements 20 may be attached to a perforated skin or sleeve, which fits over a traditional wire cloth 10.

Another advantage of 3D printing is that it provides flexibility. For example the resulting mould cover may have attached thereto a number of discrete watermark formation elements 20 at regular intervals, each watermark formation element 20 being designed to produce a single watermark. The watermark formation elements 20 may all be designed to produce the same watermark, or different watermarks.

Figure 19:
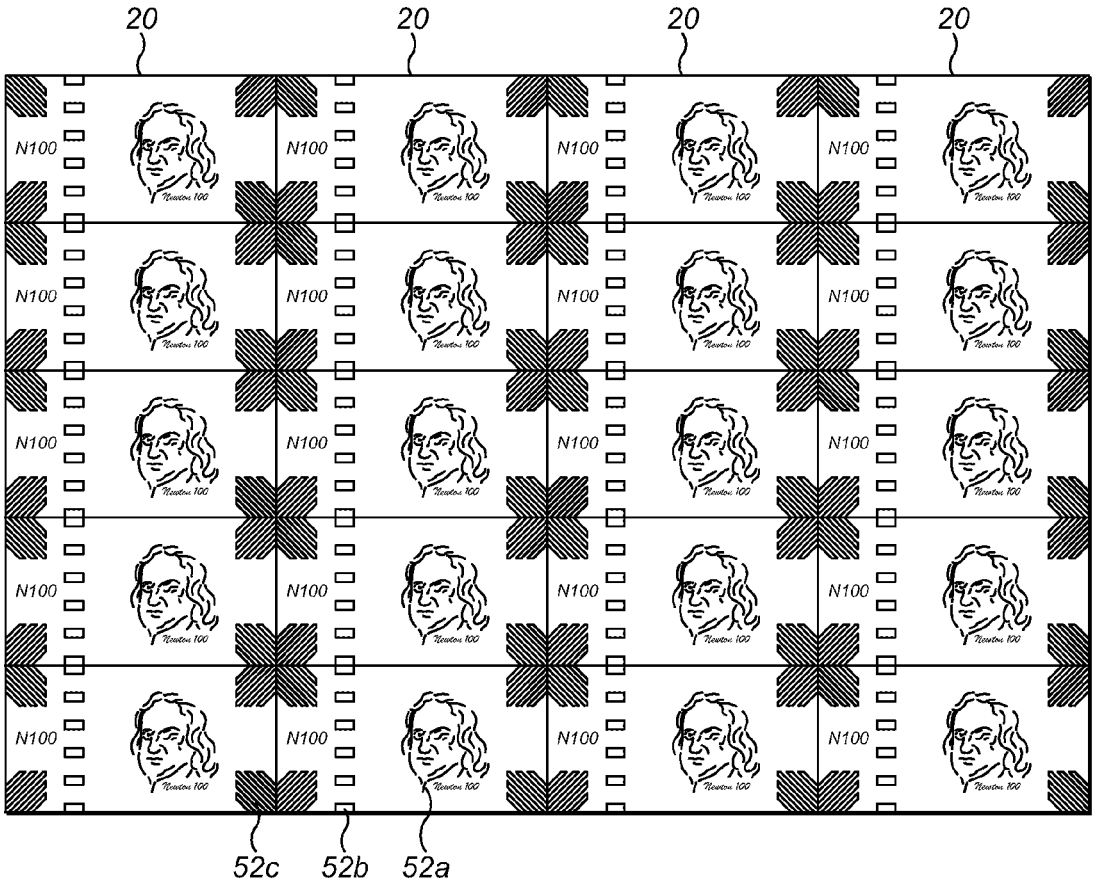
FIG. 19 is a tessellated sheet section made up of the watermark formation elements of FIG. 18.

As described previously a number of webs may be produced simultaneously on a cylinder mould papermaking machine. The webs are cut to form a number of smaller interim sheets, and the interim sheets are cut to form a number of smaller documents (usually after printing). Each watermark formation element 20 may be the same size as a single document (see FIG. 18) and be designed to produce all the watermarks (and holes or apertures) required for a single document. This may include several different watermarks 52*a*, 52*b*, 52*c*, 52*d*. These watermarks 52*a*, 52*b*, 52*c*, 52*d* may be, inter alia, pictorial watermarks, corner reinforcing watermarks, security thread tracks and/or electrotype style alphanumeric watermarks. Sufficient identical watermark formation elements 20 may be attached to the wire cloth 10 adjacent each other (to form a tessellated sheet section as shown in FIG. 19) to produce an interim sheet which, when slit, will form a number of identical smaller documents all having the same combination of watermarks 52*a*, 52*b*, 52*c*, 52*d*. This may be repeated around the circumference of the mould cover, so that at least one of the paper webs can be split to form identical interim sheets and then identical documents.

The use of the aforementioned watermark formation elements 20 in the manufacture of paper is particularly advantageous where each one designed to produce multiple watermarks 52*a*, 52*b*, 52*c*, 52*d*. During the papermaking process, the paper shrinks at an uneven rate across the web. Thus, in order to ensure that the watermarks 52*a*, 52*b*, 52*c*, 52*d* in the finished document are correctly positioned, the position of the elements of the watermark formation surface 21 which produce the individual watermarks 52*a*, 52*b*, 52*c*, 52*d* may vary depending on where on the web the watermark is being formed. The use of 3D printing simplifies this process.

Figure 21:
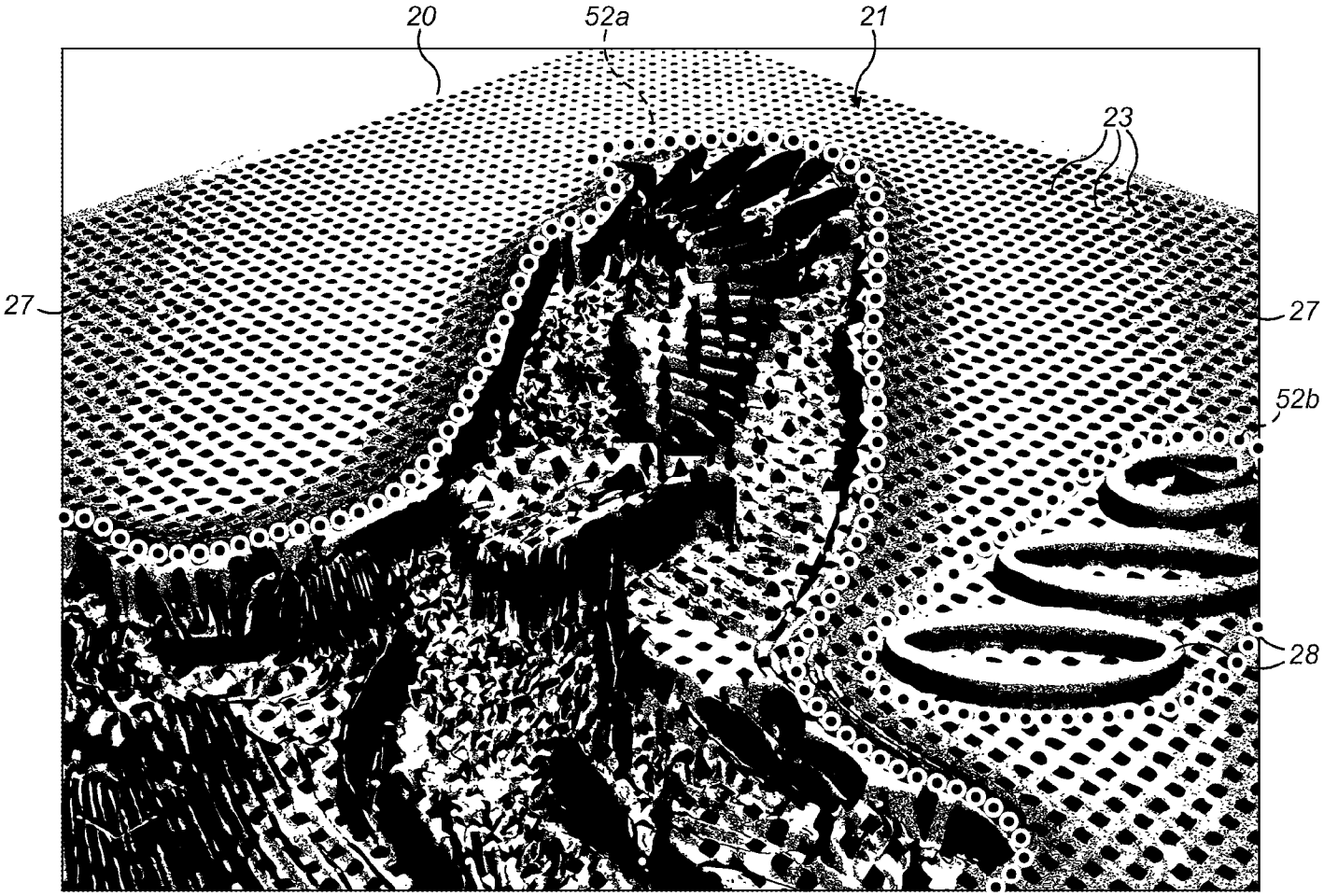
FIGS. 21 to 24 and 26, 27, 28*a* and 28*b* are parts of different watermark formation surfaces of different watermark formation elements.

FIG. 21 provides a clear illustration of a section of a watermark formation surface 21 of a watermark formation element 20, part of which has a contoured profile. In this example, one watermark (in the shape of a bird of which a section of the bird's wing is shown) has raised and sunken elements. This produces a watermark similar to that of a prior art cylinder mould watermark. Another watermark is formed from solid areas 21 in the form of the numerals "0", which are raised above the rest of the watermark formation surface 21. This produces a watermark similar to that of a prior art electrotype watermark.

It is also possible to use different sets of watermark formation elements 20 to form different sheets or webs, which means that more than one type of document may be produced simultaneously on a single cylinder mould.

Figure 20:
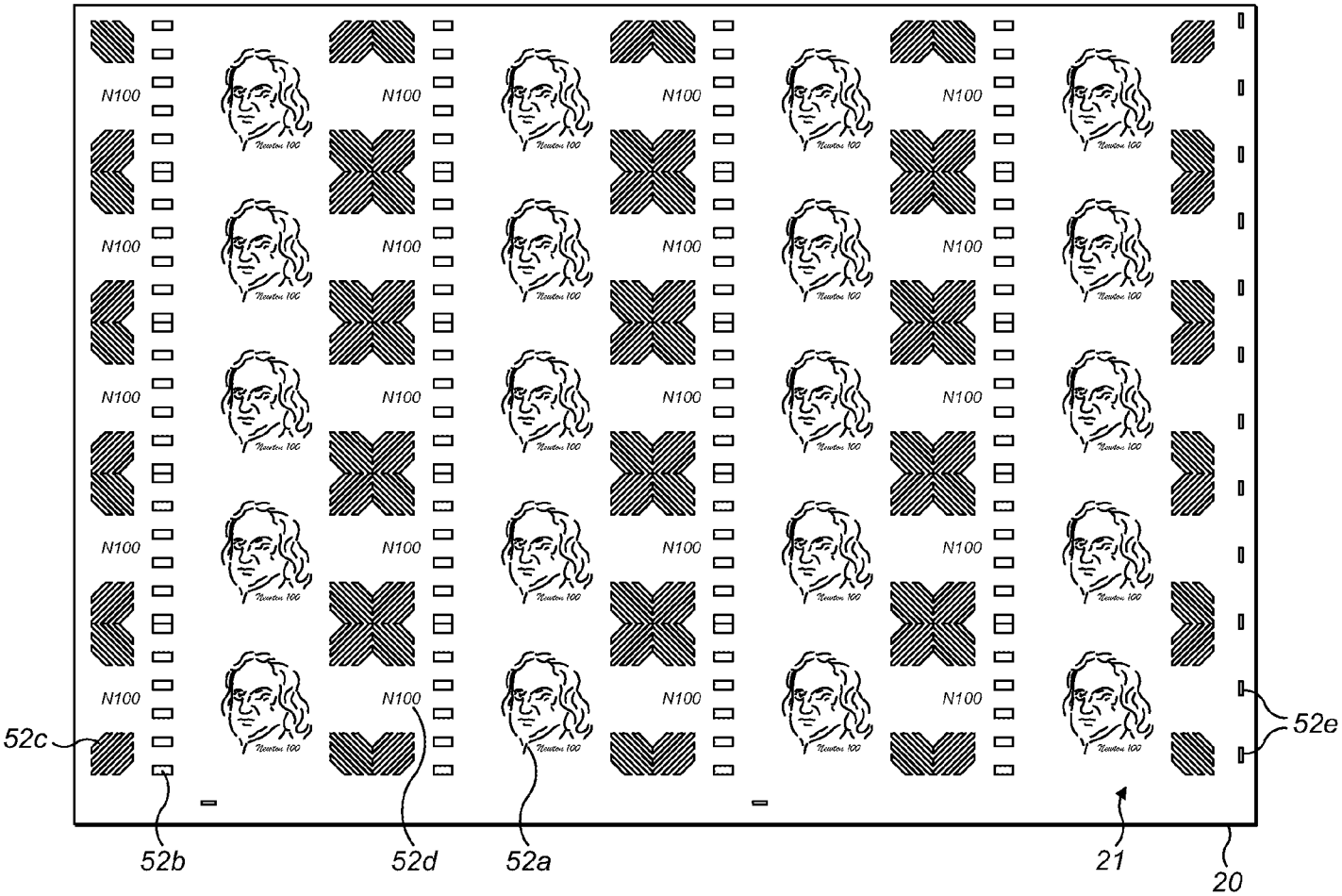
FIG. 20 is a single watermark formation element used to produce multiple documents having identical watermarks

Alternatively, instead of tessellating a number of individual identical watermark formation elements 20 to enable an interim sheet to be produced, a single watermark formation element 20 can made, which is designed to produce all the required watermarks 52*a*, 52*b*, 52*c*, 52*d* for multiple documents (see FIG. 20). In addition the watermark formation element 20 can be used to provide slitter/chop guide marks 52*e*, which are used to assist in the accurate cutting of the webs/sheets. Margins may also be included between the areas which will form an individual document, which can be used as fixing points. Fixing points are required for attaching different sets of watermark formation elements 20 used to form different webs either together or to the cylinder mould cover. These will be cut away when the paper is slit into the individual interim sheets and then the documents.

As a further alternative, the entire face cloth 11 of a cylinder mould cover may be a watermark formation element 20 formed by 3D printing. In addition the backing layers 12,14 may also be 3D printed.

In a traditional process using an embossed cylinder mould, the presence of many embossings can make it difficult to hold the mould cover firm whilst the wire cloth 10 is being embossed. The use of watermark formation elements 20 overcomes this disadvantage as they are formed separately.

Advantageously, the watermark formation elements 20 are produced so as not to have the knuckles associated with the woven wire mesh of the face cloth. This eliminates interference of the watermark image by the image of the wire knuckles which is inevitably produced in the paper.

Further manufacturing problems may arise where a watermark is to be combined with another security feature, such as traditionally formed corner reinforcing watermarks as described in EP-A-1468142 or security threads. In these cases the order or steps in manufacturing the wire cloth is important. For example any embossings required for these other security features may need to be carried out before any cut out areas 15 are formed (for example by laser cutting) to prevent distortion of the wire mesh from occurring which may affect watermark formation elements 20. The watermark formation elements 20 may then be inserted into the recesses 43 or through the cut out areas 15 as required.

The watermarked paper thus produced is suitable for many applications, including paper used in banknotes, passports, certificates, tickets and many more applications. It is especially convenient for producing paper for passports, which have a complex layout and require different watermarks on each page.

The invention claimed is:

1. The watermark formation element for forming at least one watermark in a paper, the watermark formation element comprising:

an integrated body comprising a watermark forming surface, which has one or more watermark forming regions, and a drainage surface, the watermark formation element having a plurality of drainage channels extending from front surface apertures in the watermark forming surface to the drainage surface, wherein the front surface apertures are shaped to define at least two different shapes, wherein at least some of the front surface apertures are shaped to define at least one alpha numeric, symbol or pictorial image.

2. The watermark formation element as claimed in claim 1, further comprising a filter layer located between the watermark forming surface and the drainage surface having filter layer apertures which have a maximum width that is less than a smallest width of the front surface apertures.

3. The watermark formation element as claimed in claim 2, wherein the filter layer apertures have a width that is in the range of 0.1 to 1 mm.

4. The watermark formation element as claimed in claim 2, wherein the integrated body has a maximum distance from the watermark forming surface to the filter layer is in the range of 0.1 to 3.0 mm.

5. The watermark formation element as claimed in claim 2, wherein the filter layer has a thickness in a range of 0.1 to 1.0 mm.

6. The watermark formation element as claimed in claim 1, wherein the at least two different shapes defined by the front surface apertures are negative or positive.

7. The watermark formation element as claimed in claim 1, wherein at least one of the at least two different shapes defined by the front surface apertures is positive and at least one of the at least two different shapes defined by the at least some of the front surface apertures is negative.

8. The watermark formation element as claimed in claim 1, wherein the watermark formation element is formed from a plurality of layers, each layer being provided with drainage apertures, the drainage apertures in each layer at least partially overlap the drainage apertures in any adjacent layers of said plurality of layers to form said drainage channels.

9. The watermark formation element as claimed in claim 8, wherein each layer is formed from a plurality of sub layers.

10. The watermark formation element as claimed in claim 8, wherein the layers and/or sub layers are fused together to form the integrated body.

11. The watermark formation element as claimed in claim 8, wherein the drainage apertures have a shape that is different in different layers of said plurality of layers.

12. The watermark formation element as claimed in claim 8, wherein the drainage apertures have a cross sectional area and/or shape that are not all the same.

13. The watermark formation element as claimed in claim 8, wherein the layers are planar.

14. The watermark formation element as claimed in claim 8, wherein the layers are non-planar.

15. The watermark formation element as claimed in claim 8, wherein the drainage apertures have a shape, size, spacing and/or distribution of that is varied within the one or more watermark forming regions to provide tonal variation in the paper formed thereon.

16. The watermark formation element as claimed in claim 1, wherein the watermark formation element is formed by 3D printing.

17. The watermark formation element as claimed in claim 1, wherein the watermark formation element is formed from a polymeric material or a plurality of different polymer materials.

18. The watermark formation element as claimed in claim 1, wherein the watermark formation element is formed from a metallic material or a plurality of different metallic materials.

19. The watermark formation element as claimed claim 1, wherein each of the front surface apertures and of any section of the drainage channels have a minimum cross-sectional area of 0.01 $mm^2$.

20. The watermark formation element as claimed in claim 1, wherein the front surface apertures have a total cross sectional area that is in the range of 1% to 40% of a total surface area of the watermark formation element.

21. The watermark formation element as claimed in claim 1, wherein the watermark forming surface is contoured in the one or more watermark forming regions to provide tonal variation in the paper formed thereon.

22. The watermark formation element as claimed in claim 1, wherein the front surface apertures that are used to form the at least two different shapes have a minimum width in the range of 0.1 to 5.0 mm.

23. The watermark formation element as claimed in claim 1, further comprising a layer which provides the drainage surface with a thickness in a range of 0.6 to 6.0 mm.

* * * * *